US006227135B1

(12) United States Patent
Pedersen

(10) Patent No.: US 6,227,135 B1
(45) Date of Patent: May 8, 2001

(54) TORSION SPRING TORQUE ARM YOKE MOORING SYSTEM

(75) Inventor: Kristen I. Pedersen, Hendersonville, NC (US)

(73) Assignee: FMC Corporation, Houston, TX (US)

( * ) Notice: Subject to any disclaimer, the term of this patent is extended or adjusted under 35 U.S.C. 154(b) by 0 days.

(21) Appl. No.: 09/579,110

(22) Filed: May 25, 2000

Related U.S. Application Data

(60) Provisional application No. 60/135,860, filed on May 25, 1999, and provisional application No. 60/174,688, filed on Jan. 6, 2000.

(51) Int. Cl.[7] ..... B63B 21/00

(52) U.S. Cl. ..... 114/230.15; 114/230.19

(58) Field of Search ..... 114/230.1, 230.15, 114/230.16, 230.17, 230.18, 230.19; 441/3–5

(56) References Cited

U.S. PATENT DOCUMENTS 3,064,615 * 11/1962 Waltman ..... 114/230.18
4,392,447 7/1983 Kaps .
4,494,475 * 1/1985 Eriksen ..... 114/230.18
4,534,740 8/1985 Poldervaart .
4,665,856 5/1987 Pedersen .
5,036,787 8/1991 Rogers .

FOREIGN PATENT DOCUMENTS

0798206 A1 3/1997 (EP) .

* cited by examiner

*Primary Examiner*—Stephen Avila
(74) *Attorney, Agent, or Firm*—Gary L. Bush; Mayor, Day, Caldwell & Keeton, LLP

(57) ABSTRACT

A soft yoke mooring system, with torsional spring devices to provide restoring force to yoke arms coupled to a mooring body. Two torsional spring device types are preferred. A first torsional spring device type includes a plurality of nested tubular shafts, which are coupled end to end to each other in a coaxial array. Torque arms extend from a yoke arm end to one end of the tubular shafts, with the other end of the shafts coupled to a vessel. A second torsional spring device type includes stacks of elastomeric shear unit arrays or blocks of elastomeric material, which are coupled between a torque diaphragm device and a vessel and with the torque diaphragm device coupled by a torque arm to an end of a yoke arm.

52 Claims, 29 Drawing Sheets

FIG.1B
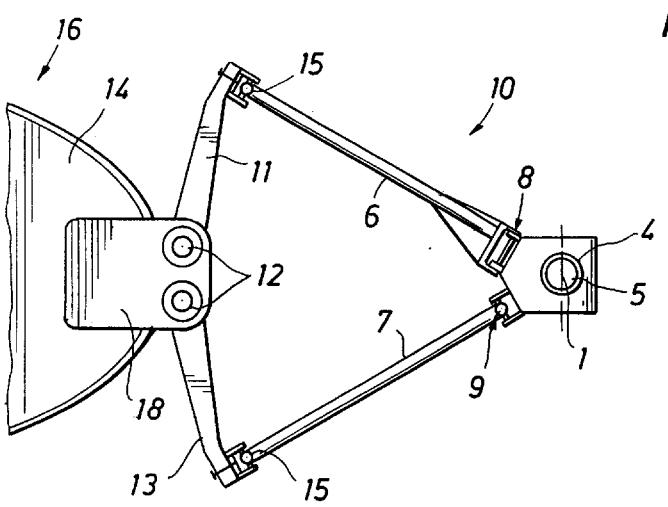
FIG.1A
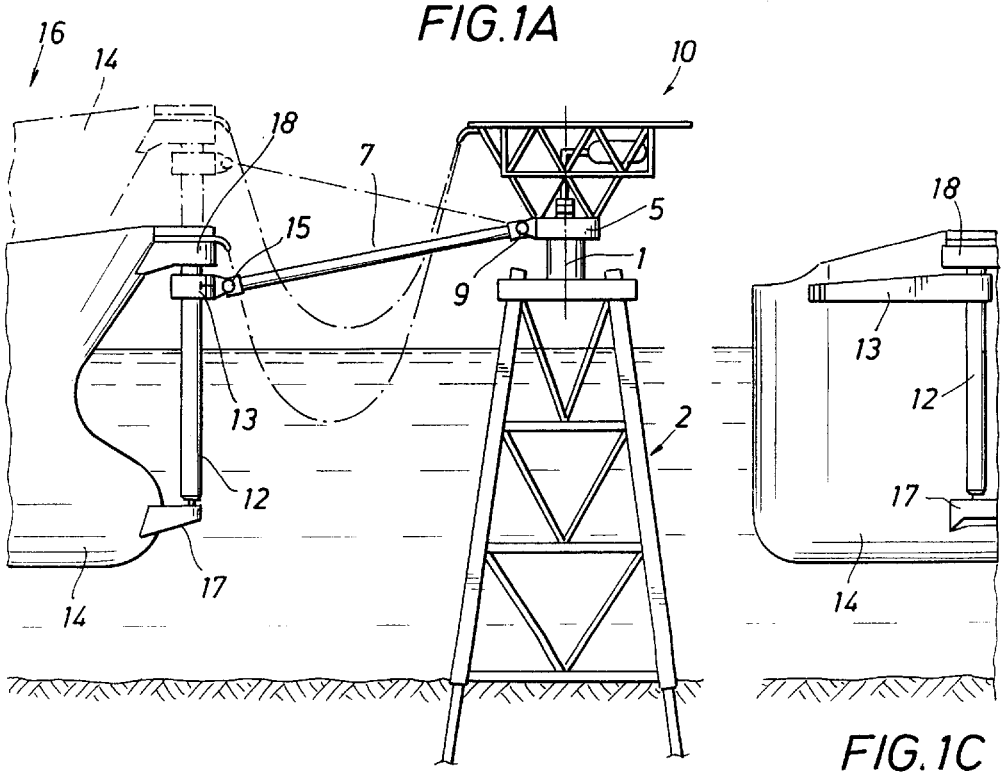
FIG.1C

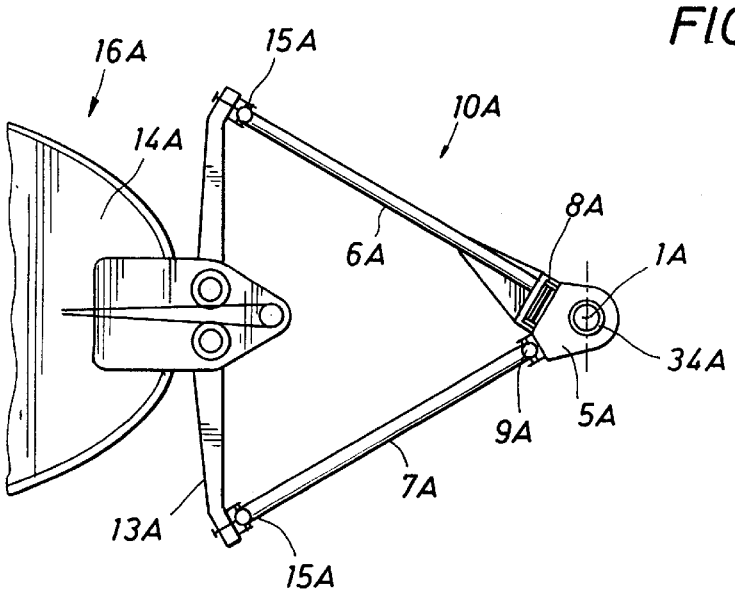
FIG. 3B
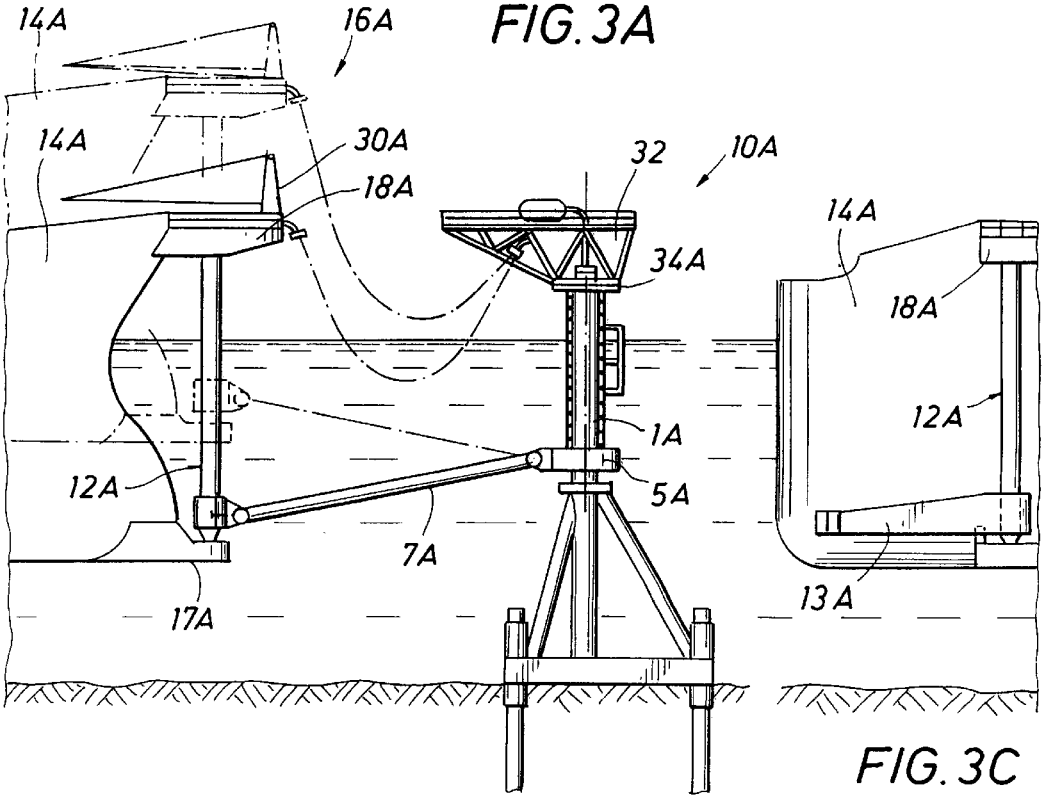
FIG. 3A
FIG. 3C

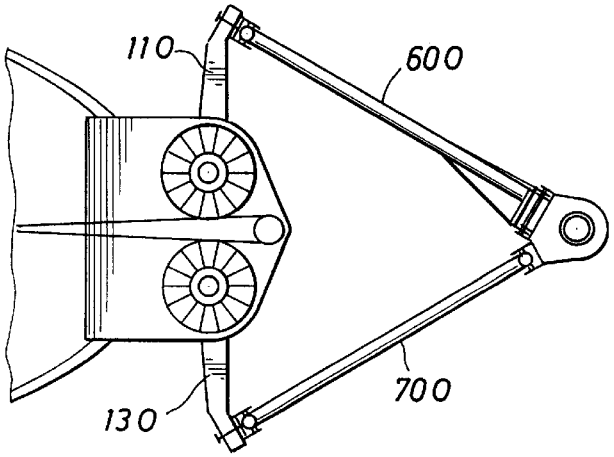
FIG. 6B
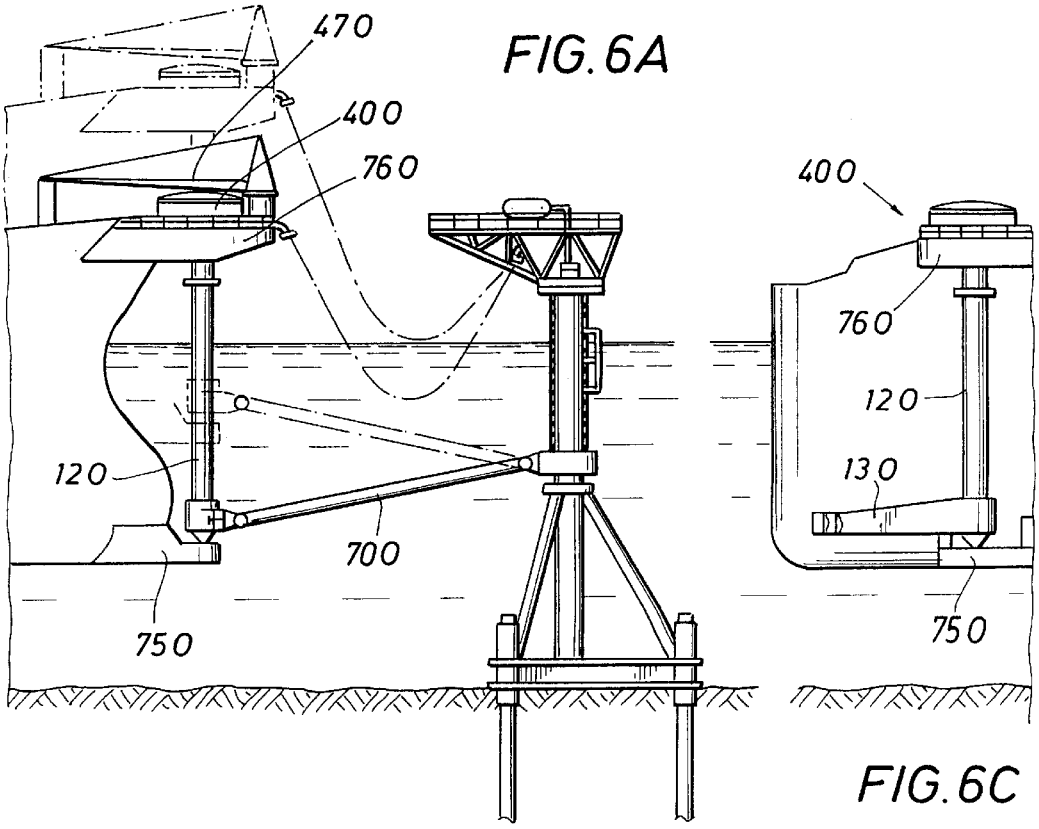
FIG. 6A
FIG. 6C

FIG. 7B
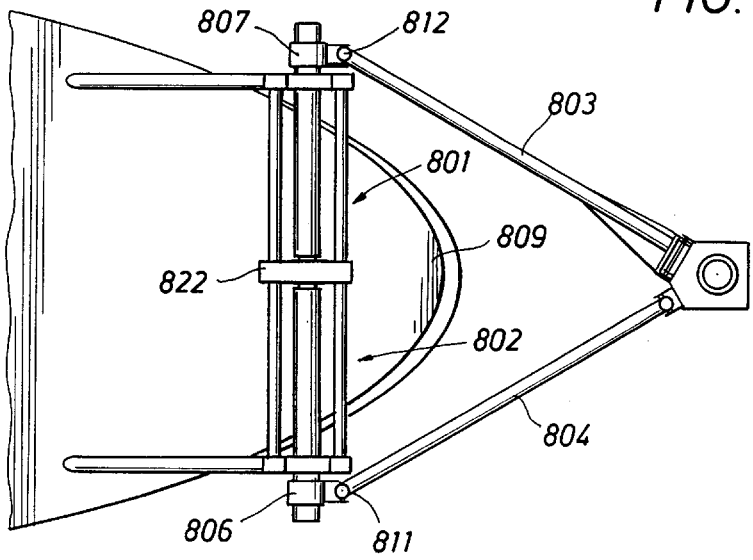
FIG. 7A
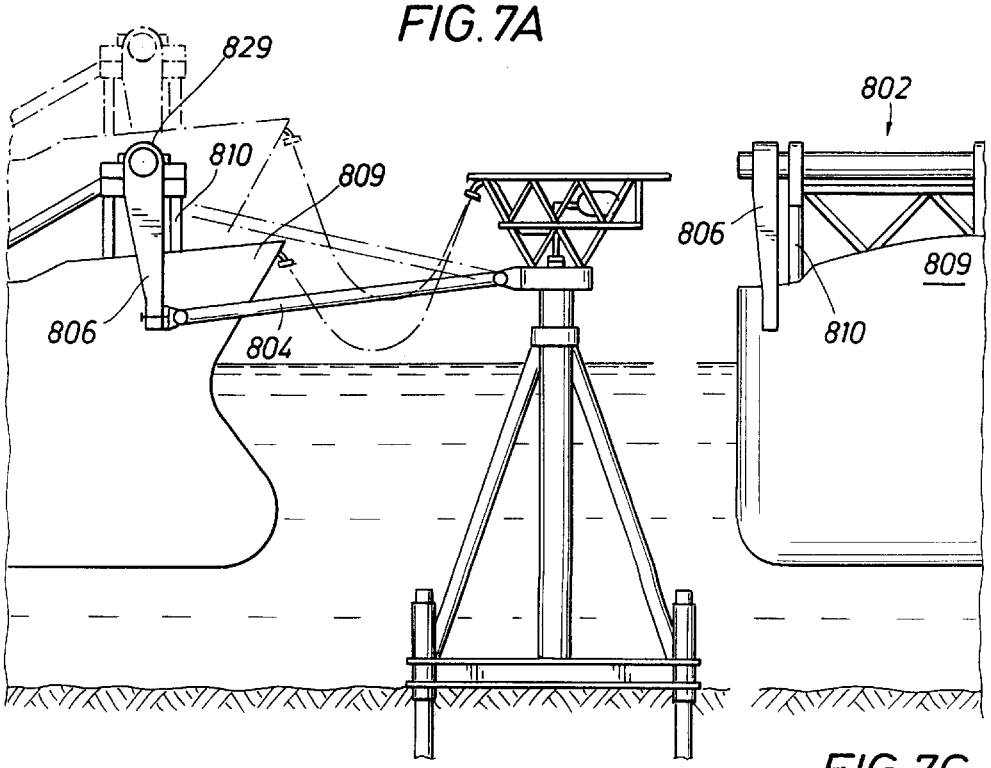
FIG. 7C

FIG.9B
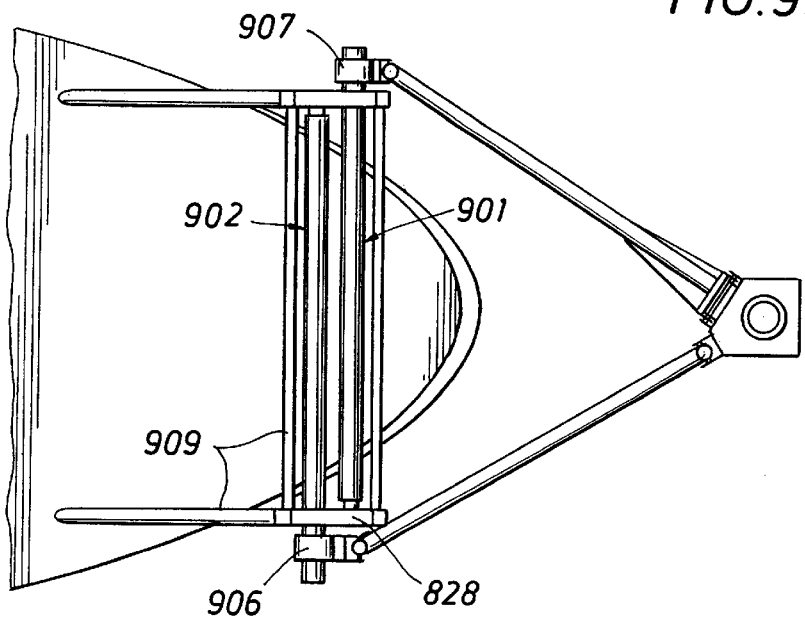
FIG.9A
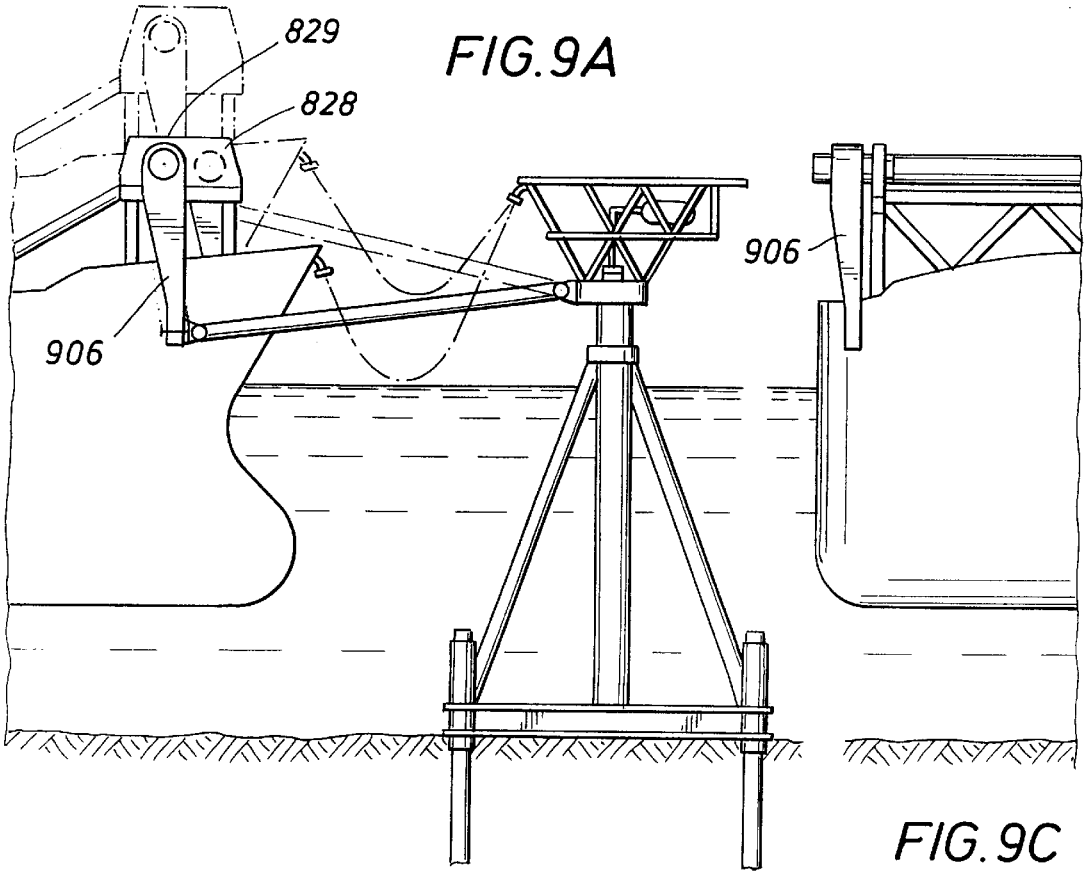
FIG.9C

FIG. 10B
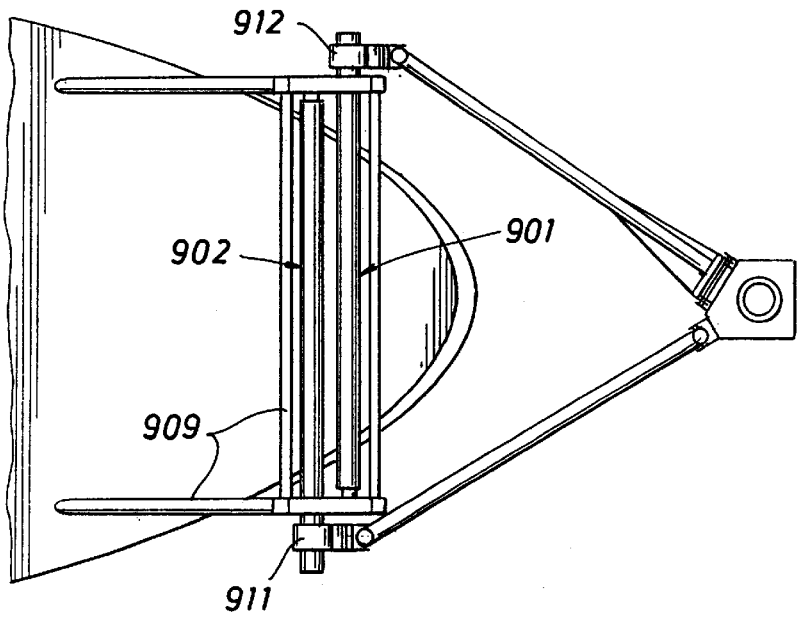
FIG. 10A
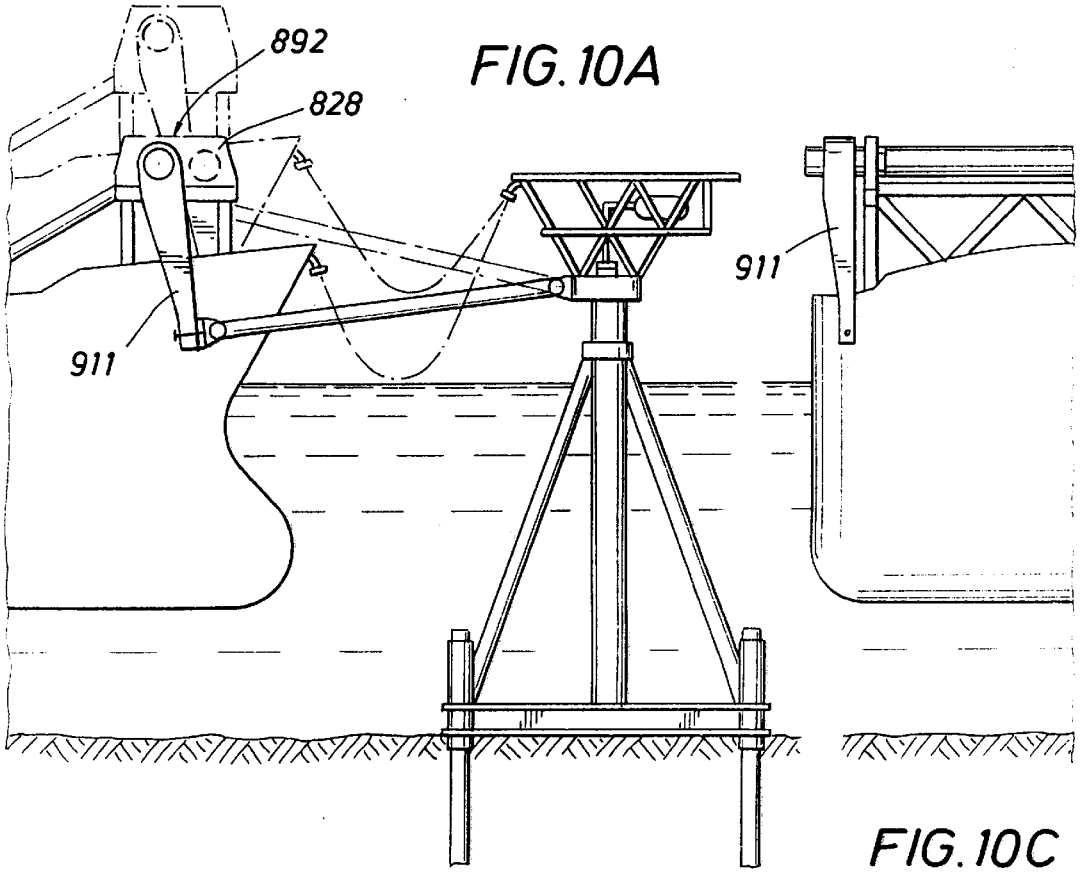
FIG. 10C

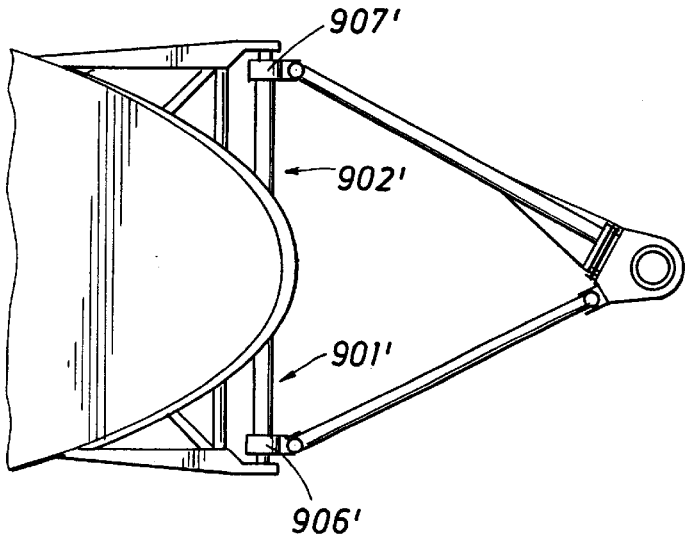
FIG. 11B
FIG. 11A
FIG. 11C
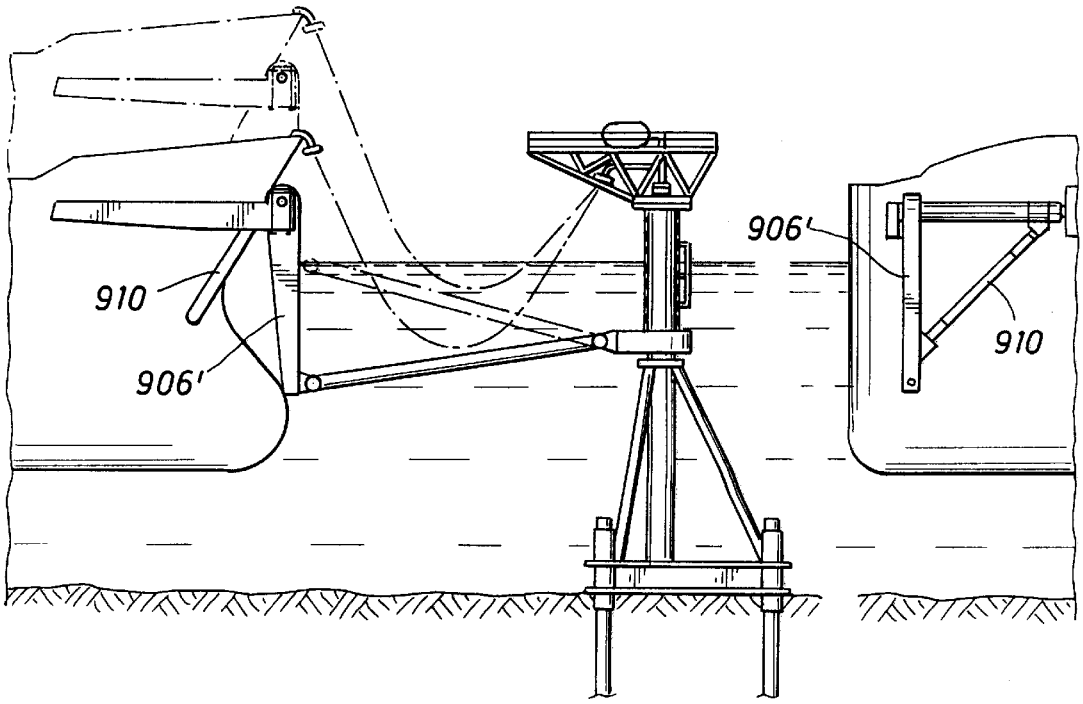

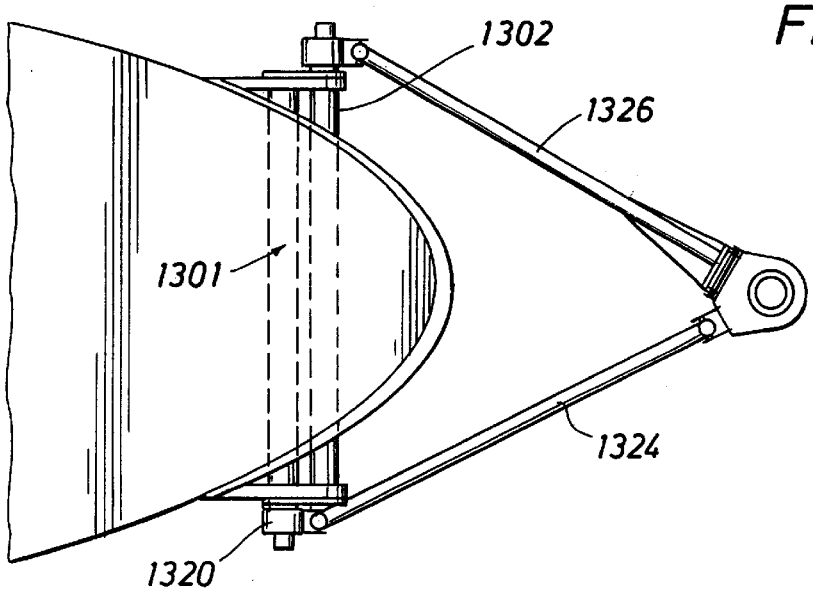
FIG.13B
FIG.13A
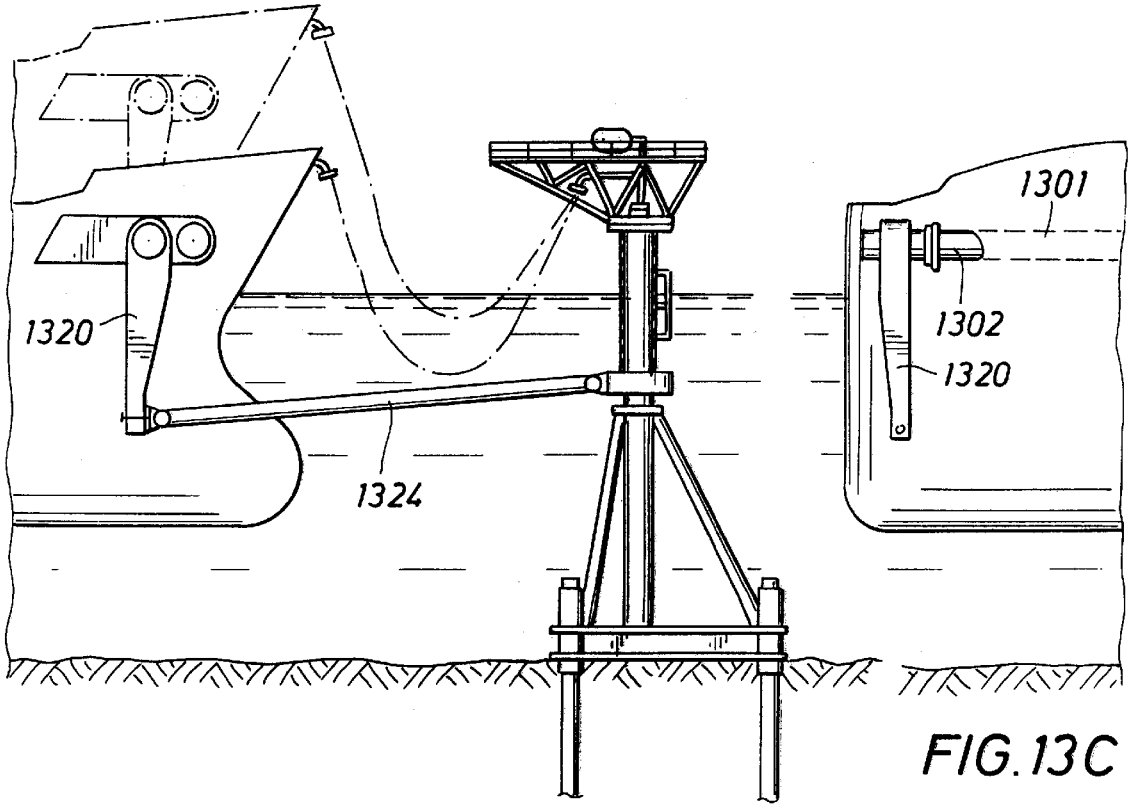
FIG.13C

FIG. 15B
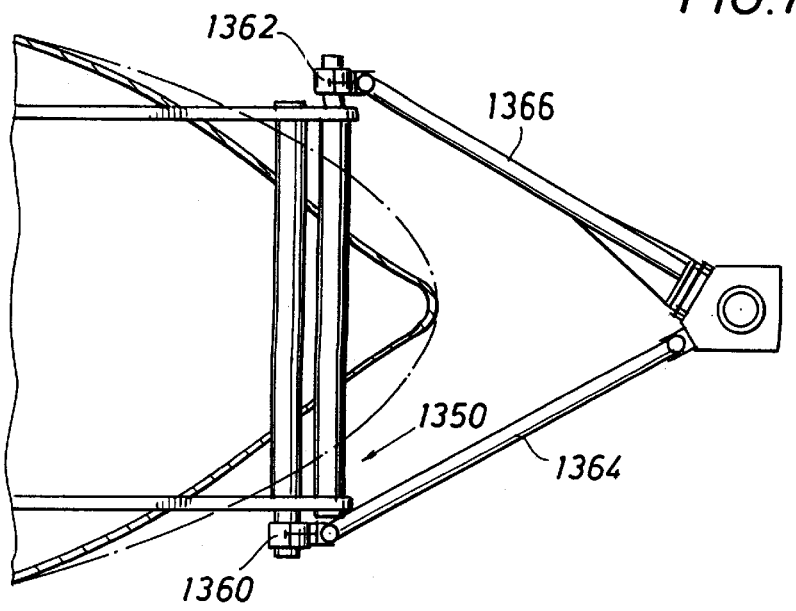
FIG. 15A
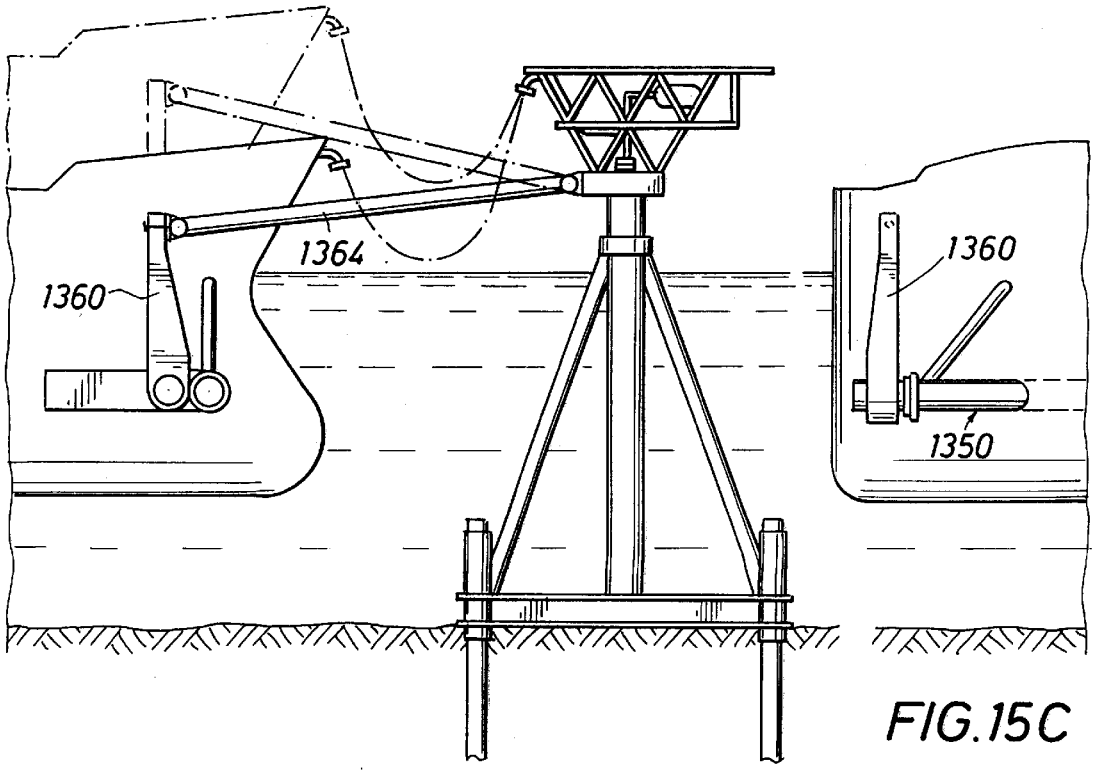
FIG. 15C

TORSION SPRING TORQUE ARM YOKE MOORING SYSTEM

REFERENCE TO PRIOR PROVISIONAL APPLICATION

This application claims priority under 35 U.S.C. §119(e) of U.S. Provisional Application No. 60/135,860 filed on May 25, 1999 and U.S. Provisional Application 60/174,688 filed on Jan. 6, 2000.

BACKGROUND OF THE INVENTION

1. Field of the Invention

This invention relates generally to the field of mooring systems for offshore tanker loading/offloading facilities. In particular, the invention relates to soft yoke mooring systems which provide a resilient restoring force for vessels moored to a fixed tower.

2. Description of the Prior Art

Soft yoke mooring systems which use heavy counterweights to provide a restoring force against vessel offset, perform well under moderate environmental conditions. Such systems also perform satisfactorily under fairly severe environmental conditions as long as wind, wave and current directions are nearly collinear.

However, under strong cross current conditions (called "crossed sea" conditions), the moored vessel will be pushed into a quartering or near broadside orientation with respect to the wave direction. The resulting yaw and sway motions of the vessel will, in turn, cause lateral oscillations of the heavy counterweights of the prior soft yoke mooring systems. For pendant lengths between 10 m and 20 m, the natural lateral oscillation period of the yoke and counterweight will be in the order of 6 to 9 seconds. This will often coincide with prevailing wave periods, causing very large counterweight oscillations due to resonance amplification. In many cases, this resonance problem may be unacceptable.

For a submerged yoke system, the fluid drag resistance of the seawater may dampen the lateral oscillations significantly. On the other hand, the submerged counterweights will also be subject to direct excitation by the wave action.

3. Identification of Objects of the Invention

It is a primary object of this invention to provide an improved soft yoke mooring system which overcomes the disadvantage of prior suspended counterweight systems.

Another object of this invention is to provide a soft yoke mooring system which provides superior performance under "crossed sea" conditions as compared to suspended counterweight systems.

Still another object of the invention is to provide a new soft yoke mooring system, which is cost effective, and competitive with prior suspended counterweight systems, especially under severe environmental conditions.

SUMMARY OF THE INVENTION

Rather than using heavy suspended counterweights to provide a resilient restoring force for keeping a moored vessel on station, the soft yoke mooring system of this invention uses torsional spring energy to provide the required restoring force.

Torsional spring energy is provided in two ways in several embodiments of the invention. The first way uses multiple, high strength steel tubular shafts to provide the required torsional spring energy. The tubular shafts are assembled in a nested coaxial array and interconnected to provide effective torsion shaft lengths of up to 100 m or more.

The second way uses torsional spring energy provided by an elastomeric torque spring arrangement. The torque spring arrangement is built up from standard elastomeric shear fender units arranged in a circular or circular arch pattern.

Both sources of torsional spring energy are relatively simple mechanical arrangements. The structural arrangements of the soft yoke system present a "clean-cut" appearance and are functional. The mechanical hinge and U-joint components of the torque arm mooring system are similar in design to that for existing soft yoke systems.

BRIEF DESCRIPTION OF THE DRAWINGS

The objects, advantages and features of the invention will become more apparent by reference to the drawings which are appended hereto and wherein illustrative embodiments of the invention are shown, of which:

FIGS. 1A, 1B, and 1C are side, top and end views of a first alternative embodiment of the invention with vertical steel tubular shaft torsion springs provided in torque shaft assemblies and with an above-water yoke;

FIGS. 3A, 3B and 3C are side, top and end views of a second alternative embodiment of the invention with vertical steel tubular shaft torsion spring provided in torque shaft assemblies and a submerged yoke;

FIGS. 6A, 6B and 6C are side, top and end views of a fourth alternative embodiment of the invention with a surface mounted elastomeric torque spring coupled to a torque shaft which in turn is coupled to a submerged yoke of a soft yoke mooring system;

FIGS. 7A, 7B and 7C are side, top and end views of a fifth alternative embodiment of the invention with in-line horizontal steel tubular shaft torsion springs provided in torque shaft assemblies and with an above-water yoke;

FIGS. 9A, 9B and 9C are side, top and end views of a sixth alternative embodiment of the invention with offset horizontal torsion shaft assemblies and with above-water yoke arms;

FIGS. 10A, 10B and 10C are side, top and end views of a sixth alternative embodiment which is similar to the arrangement of FIGS. 9A, 9B and 9C but with torque arms slanted in opposite directions from the vertical;

FIGS. 11A, 11B and 11C are side, top and end views of a seventh alternative embodiment of the invention with in-line horizontal torsion shafts with submerged yoke arms;

FIGS. 13A, 13B and 13C are side, top and end views of an eighth alternative embodiment of the invention with offset horizontal torsion shafts with submerged yoke arms;

FIGS. 15A, 15B and 15C are side, top and end views of submerged horizontal tension shafts with above-water yoke arms.

DESCRIPTION OF PREFERRED EMBODIMENTS OF THE INVENTION

Figures 2, 2A:
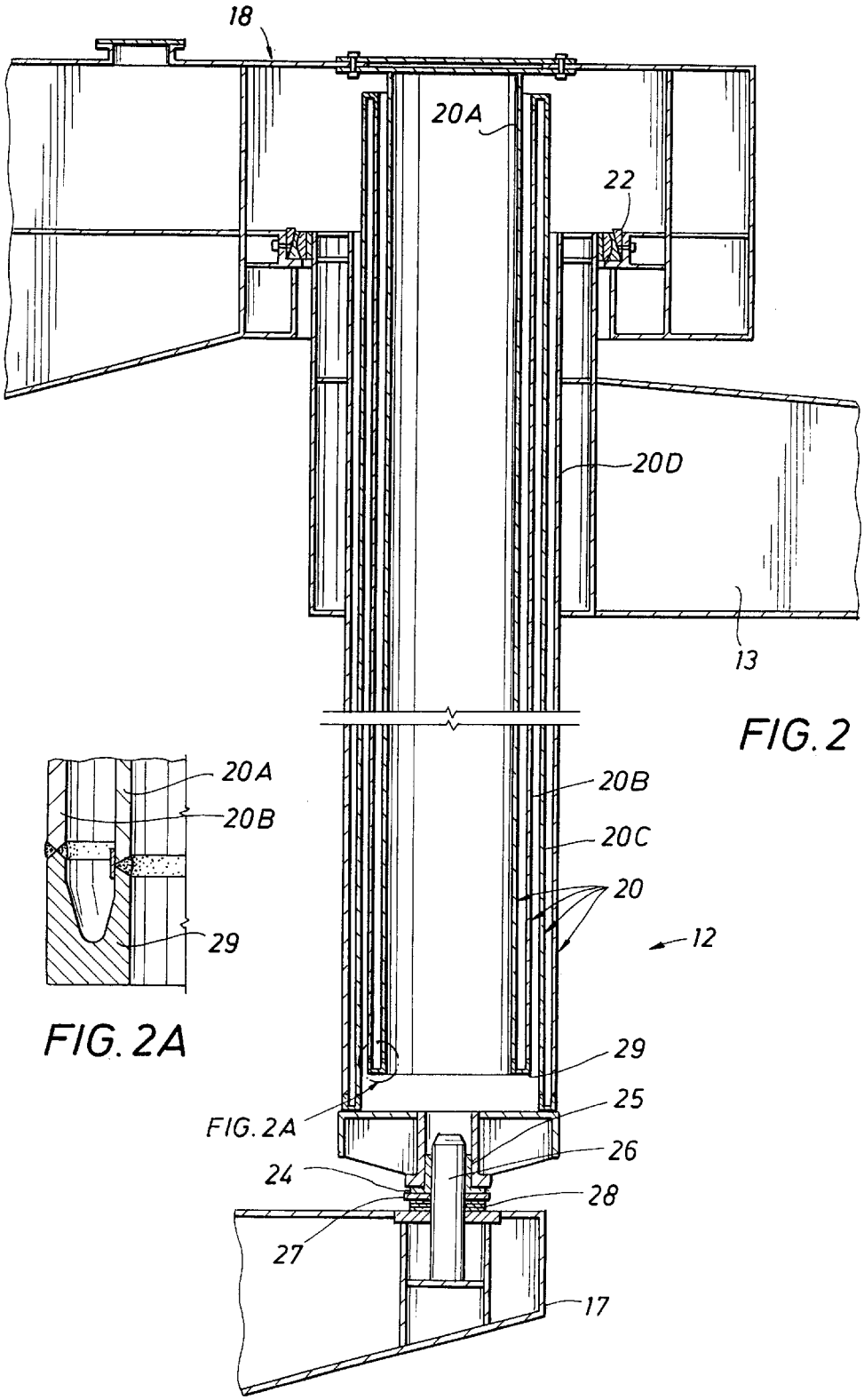
FIG. 2 is a detailed sectional view of a torque shaft assembly of FIGS. 1A and 1B.
FIG. 2A is a detail of the securement of the ends of nested coaxial torsion shafts.

Alternative 1—Torsion Shaft Assembly with Above-Water Yoke—FIGS. 1A, 1B, 1C, 2

The main components of the torque arm yoke arrangement 10 of FIGS. 1A, 1B and 1C are the two torque shaft assemblies 12 mounted vertically off the bow 14 of the FSO or FPSO vessel 16.

The arrangement includes a tower or jacket 2, which is fixed to the seabed. A mooring buoy or other equivalent structure that is substantially stationary with respect to the sea floor could be substituted for the preferred tower. A three-race roller bearing 4 couples a turntable frame 5 to a vertical shaft 1. Yoke arms 6, 7 are coupled to the turntable frame 5 by means of a single axis hinge 8 and a dual axis U-Joint 9 respectively. The opposite ends of yoke arms 6, 7 are coupled to outer ends of torque arms 11, 13 by means of tri-axial U-Joints 15. The inner ends of the torque arms 11, 13 are secured to torque shaft assemblies 12, which in turn are coupled to vessel 14 by lower 17 and upper 18 support brackets. The torque shaft assemblies 12 function as torsion springs between the vessel support brackets 17, 18 and the torque arms 11, 13.

An equilibrium position is illustrated in FIG. 1B. If the vessel 16 moves radially away from or toward the tower 2, the torque shaft assemblies provide a restoring torque to torque arms 11, 13 toward the equilibrium position. The side view of FIG. 1A illustrates in solid lines the vessel and the yoke arm 7 under conditions of 100% draft of the vessel, with the U-Joint 9, single axis hinge 8 and U-Joints 15 allowing the yoke arms 6, 7 to adjust to the difference in vertical height of the vessel 14 and the turntable frame 5 of tower 2. The dashed lines show the orientation of the vessel, for example at 42% draft, where the yoke arms are angled upwardly between the unloaded vessel 14 and the turntable frame 5 of tower 2. (Other illustrations below of embodiments of the invention are also illustrated with the vessel fully loaded and in 42% draft condition.)

A swivel and frame atop the tower 2 and product lines running from the frame to the vessel are illustrated schematically to show that a flow line transfer system is superimposed upon the mooring components, which keep the vessel 14 on station about a tower 2 or other substantially stationary mooring body such as a buoy. The vessel 16 and the flow line transfer system are capable of weathervaning in a 360° arc about the tower by virtue of the coupling of the yoke arms 6, 7 to the three race bearing 4.

The basic details of the torque shaft assemblies 12 are shown in FIG. 2. In this embodiment, four torsion shafts 20 (i.e., 20A, 20B, 20C, 20D) are nested coaxially inside each other and interconnected end to end to function as a continuous torsion shaft, four times as long as the actual assembly height. More than four or fewer than four nested shafts may be used, depending on design parameters.

The inner shaft 20A has the upper end fixed to the upper support bracket 18. A torque arm 13 is attached near the top of the outer shaft 20D. The radial bearing arrangement at the top end of the outer shaft 20D is shown as an adjustable bearing shoe arrangement, similar to radial bearing designs illustrated in U.S. Pat. No. 5,240,446, which is incorporated by reference herein. The weight of the torsion shaft assembly is supported by a self-lubricating thrust washer or bearing 24 on plate 27, which is part of the radial load pintle bearing 25 at the bottom of the shaft assembly 17. A pintle 26 extends upwardly from lower support bracket 17. An elastomer sandwich pad or load equalizer 28 cushions the weight of the shaft assembly between plate 27 and the lower support bracket 17. FIG. 2A illustrates that the ends of nested torsion shafts 20A, 20B are fixed by welding an end ring 29 to the ends of shafts 20A, 20B.

Torsion shaft dimensions, and the number of nested shafts in each torsion shaft assembly, are predetermined by conventional engineering design methods to satisfy any given requirement for yoke restoring force versus vessel offset. Four shafts are preferred in the embodiment of FIGS. 1A, 1B, 1C, and 2. The shaft material will generally be high strength steel. Titanium, which permits comparatively large shear distortions for a given stress level, would be an ideal torsion shaft material, yet the high cost of titanium may be prohibitive in most cases. The torsion shafts can also be made of some form of composite fiber reinforced material.

Selection of material and dimensions of the torsion shafts will also be affected by considerations of fatigue effects on the shaft material and the joint details. The joint detail shown in FIG. 2A represents one possible joint configuration. Other joining arrangements may be preferred for reasons of superior fatigue endurance, or easier fabrication and assembly procedures.

For the above-water system, as illustrated in FIGS. 1A, 1B and 1C, tower access is provided via walkways along a torque arm and an adjacent yoke arm.

Alternative 2—Torsion Shaft Assembly with Submerged Yoke—FIGS. 3A, 3B, 3C, 4

Figures 4, 4A:
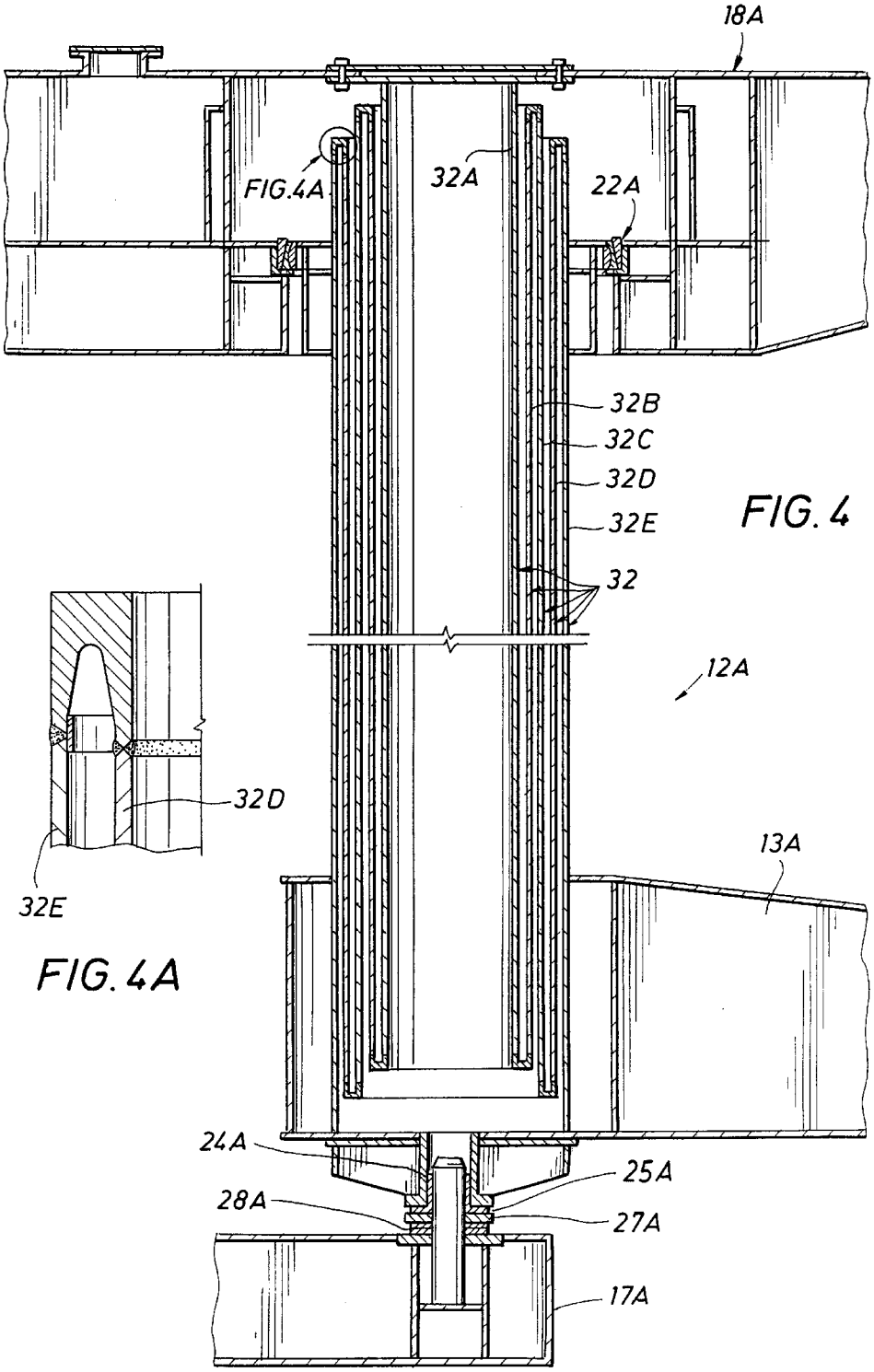
FIG. 4 is a detailed sectional view of a torque shaft assembly of FIGS. 3A, 3B and 3C.
FIG. 4A is a detail of the securement of the ends of nested coaxial torsion shafts.

This arrangement is generally identical to the above-water yoke version of Alternative 1, except for the submerged yoke with arms 6A, 7A attached near the bottom of the torque shaft assembly 12A. To accomplish this, one more tubular shaft is added to the nested assembly for a total of five shafts 32A–32E as shown in FIG. 4.

The advantages of a submerged yoke system 10A versus an above-water yoke system 10 include reduced tower overturning moments with resulting reductions in costs of the mooring tower structure and piling requirements. However, convenient tower access requires the addition of a personnel transfer crane 30A, mounted on the forepeak of the FSO or FPSO vessel 16A as illustrated in FIG. 3A.

In the alternative arrangement of FIGS. 3A, 3B, and 3C, a self lubricating bearing (not illustrated) provides radial bearing support for frame 5A to rotate about shaft 1A, while an above sea surface three race roller bearing 34A provides axial and radial bearing support for a flowline frame 32 for fluid path components such as a swivel and flow lines running to the vessel 14A.

Alternative 3—Elastomer Torsion Spring Assembly with Above-Water Yoke: Four Versions: FIGS. 5A, 5B, 5C, 5D; 5E, 5F; 5G, 5H, 5L, 5J; 5K, 5L, 5M, 5N, 5O As illustrated in Alternatives 1 and 2 discussed above, the basic concept of the invention provides yoke arms reacting against torque arms coupled to a vessel via a torque spring system. A third alternative arrangement is similar to the previously discussed systems which employ a torsion spring in the form of nested high strength steel torsion shafts. However, in this third alternative, the torque energy is provided by an elastomeric torque spring assembly 40, as shown in FIGS. 5C and 5D.

The required torque resistance is provided by elastomeric shear units 39, arranged in circular arrays 41. Elastomeric shear units 39 are generally available and commonly used for shipping berth fendering arrangements. The units consist of approximately cubic or rectangular volumes of elastomer, with mounting plates bonded to the top and bottom surfaces. The elastomer volume is generally reinforced against compression loads, by internal steel laminations oriented parallel to the mounting faces. In the following such elastomeric shear units 39 may also be referred to as shear fender units. Three circular arrays 41 are shown in FIG. 5C. The number of actual arrays will be selected to suit the required angular torque capacity of the overall assembly 40.

The elastomeric shear unit arrays 41 are separated by, and fastened to shear plane stiffening rings 46, 47, 48. The shear plane stiffening rings provide means for coupling the shear fender arrays together, and are also essential for mobilizing the shear force capacity of the individual shear fender units by preventing detrimental tilting of individual units in the stacked assembly.

The entire assembly, including the required torque arms 11B, 13B, is built into a single torque arm module 44, which can be prefabricated and fitted into the forepeak section 14B of a FSO or FPSO vessel 16B as a single unit.

Each torque arm module 40 includes a torque shaft 42, which is secured to a torque arm (13B in FIG. 5C). The top circular array 41 of elastomeric shear units of assembly 40 has a stiffened circular torque diaphragm 50 secured to the top of shear block or fender units and to torque shaft 42.

The torque shaft 42 is rotatably supported at its upper end with respect to the vessel by means of an upper radial bearing assembly 60 which includes self lubricating bearing shoe brackets 64 with radial bearing shoes mounted on module 44 and bearing part surfaces 66 secured about the outer diameter of torque shaft 42. The torque shaft 42 is rotatably secured at its bottom end by a radial clamp arrangement 52 and a pintle bearing bushing 68 between a pintle 67 and guide aperture 69. As torque arm 13B turns with respect to assembly 40, torque shaft 42 and torque diaphragm 50 turn together a like amount. Such turning is resisted in shear by the elastomeric shear units 41 mounted on shear plane stiffening rings 46, 47, 48. As a result, the turning is resisted by a device that acts to resist torque on arm 13B. That is, it can be characterized as a torsion spring device placed between the torque shaft 42 and the torque arm module 44 or vessel 16B.

The torque capacity required for a given mooring system is basically determined by the shear force capacity of each circular array of elastomeric shear units 41, and the number of shear units 39 in each circular array 41. The angular deflection required to allow adequate vessel offset resiliency is determined by the height of shear units 39 and the number of elastomeric shear unit arrays 41 stacked on top of each other.

The elastomeric shear rings 41 include standard shear fenders 39 as supplied by a number of elastomeric fender suppliers or blocks of elastomeric material. Preferably, the shear fenders 39 are PAULSTRA shear fenders. Each shear fender ring 41 as illustrated includes a circular row with twenty-eight fenders 39 in a circular row.

The torque spring arrangement of FIGS. 5C and 5D may be characterized as a "Single Plane Shear Load Arrangement". The restoring shear forces act on one side of the torque diaphragm 50.

Figure 5B:
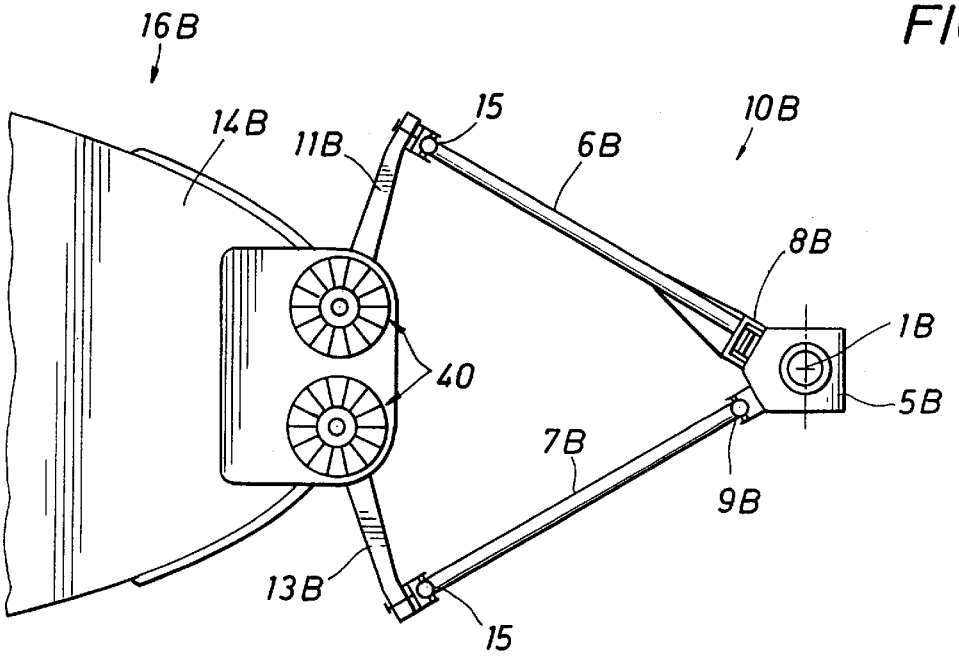
FIGS. 5A and 5B are side and top views of a third alternative embodiment of the invention with vertically oriented elastomeric torque springs coupled between the vessel and a torque arm of an above-water soft yoke mooring system.
Figure 5A:
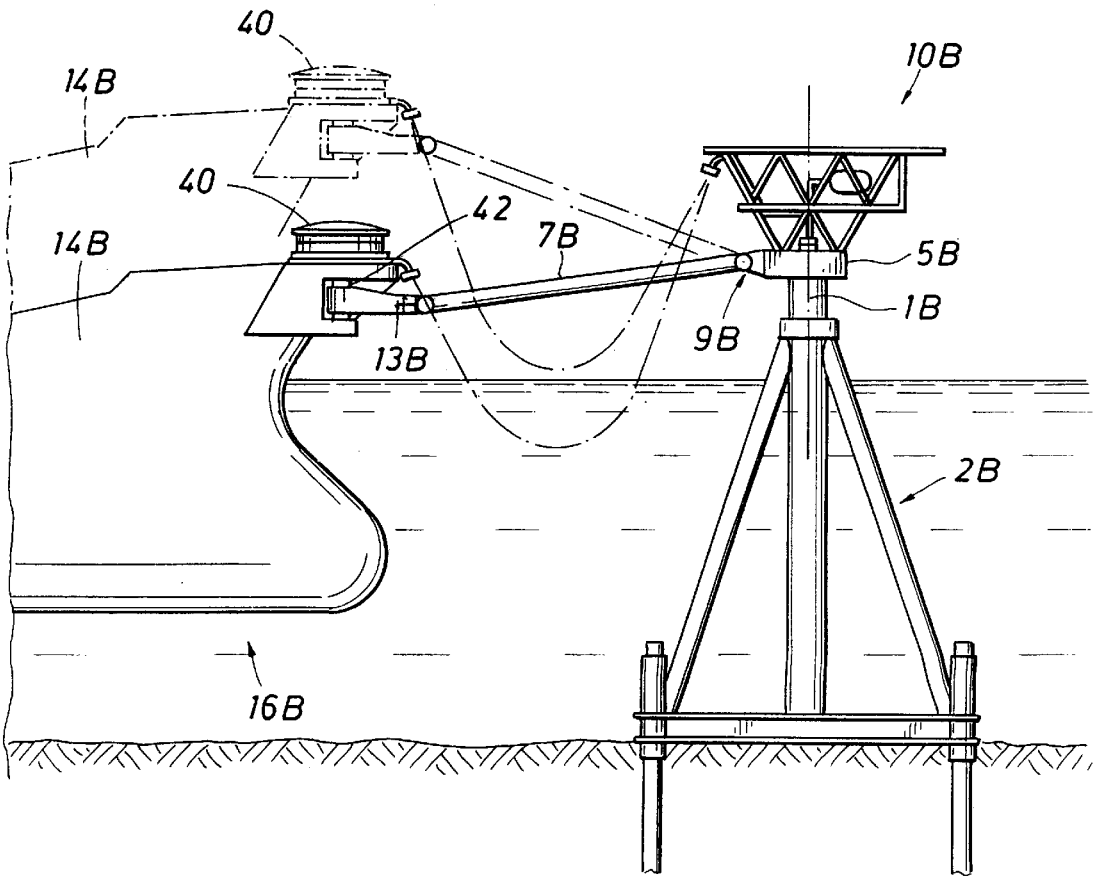
Figure 5D:
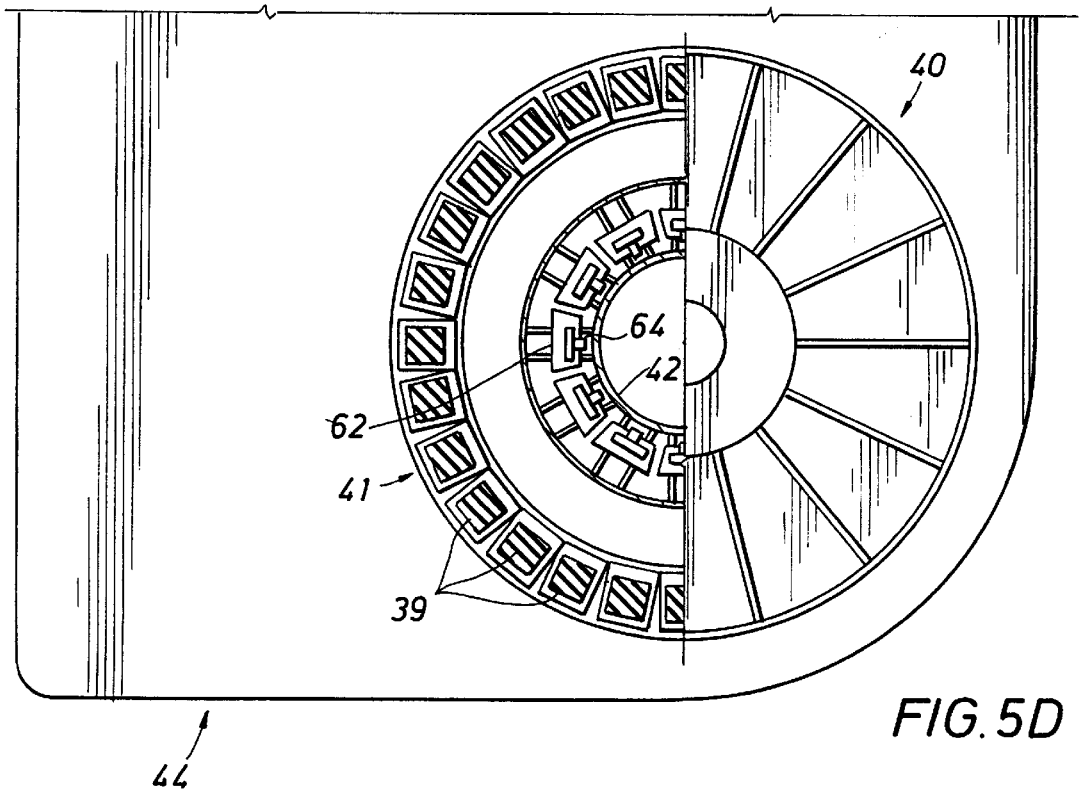
FIGS. 5C and 5D are side and top views, partially in section, which show details of construction of the elastomeric torque spring of FIGS. 5A and 5B, with a section and top view taken along lines 5D—5D in FIG. 5C presented in FIG. 5D.
Figure 5C:
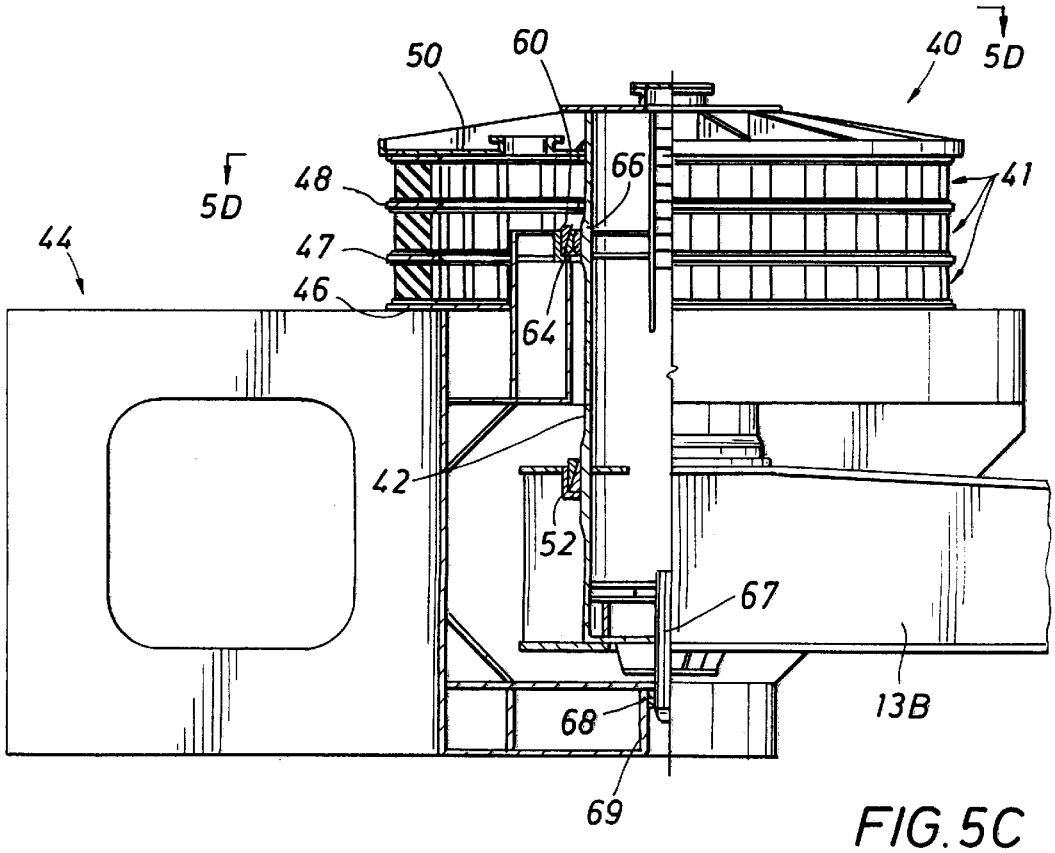
Figure 5E:
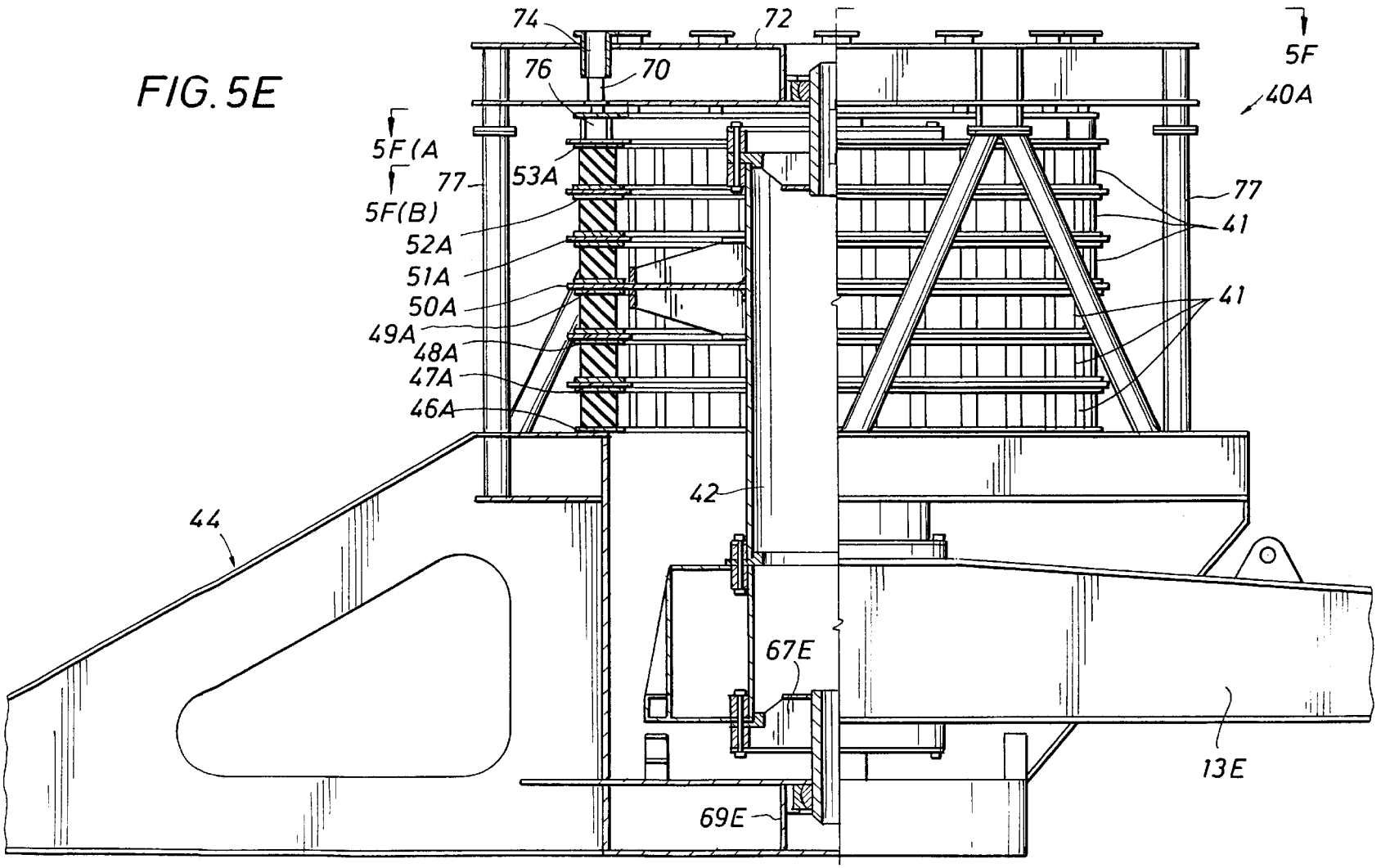
FIGS. 5E and 5F are side and top views, partially in section, which show details of anal construction of the elastomeric torque springs of FIGS. 5A and 5B, with sections along lines 5F—5F(A) and 5F—5F(B) and a partial top view of FIG. 5E presented in FIG. 5F.
Figure 5F:
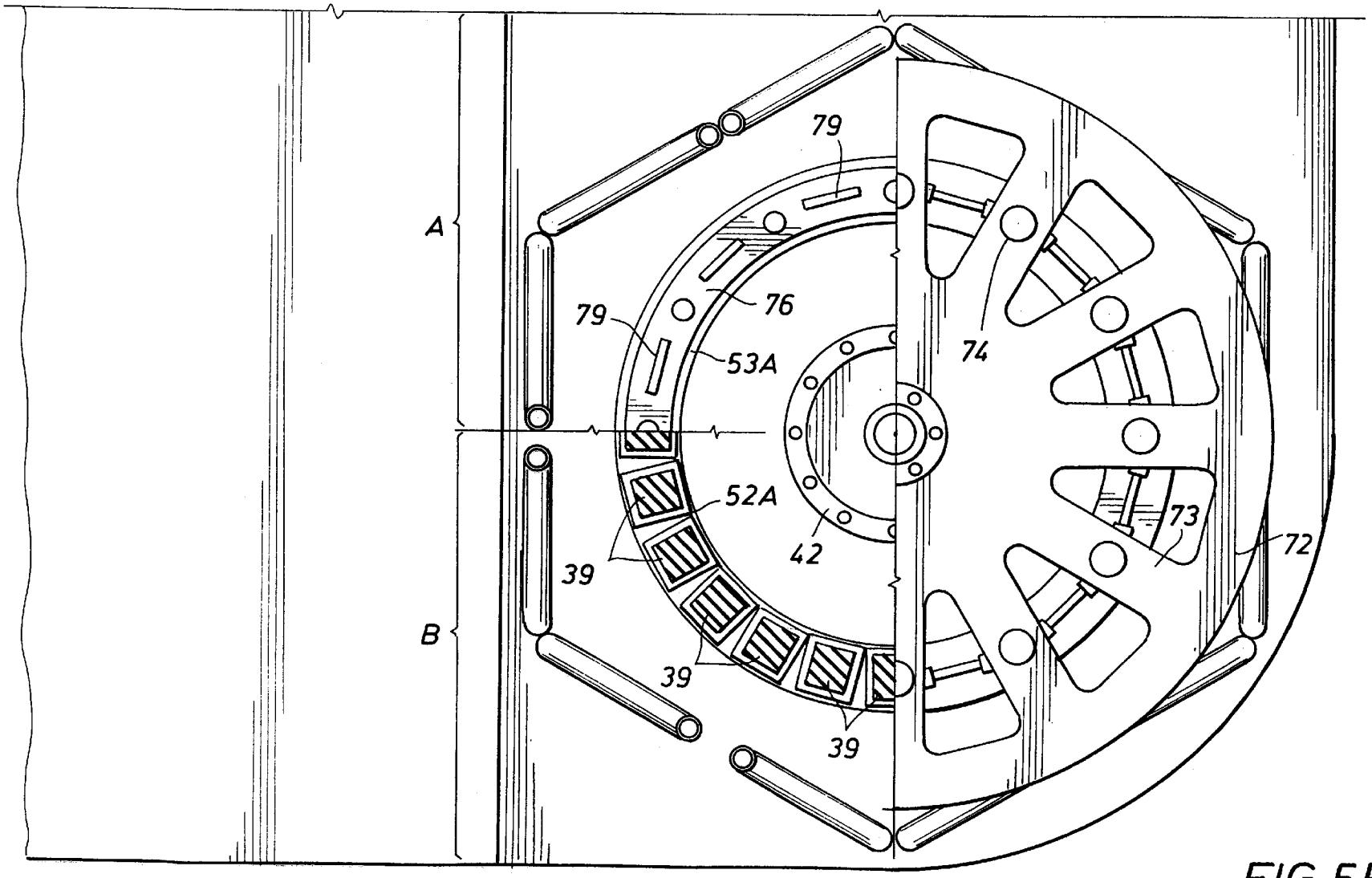
Figure 5H:
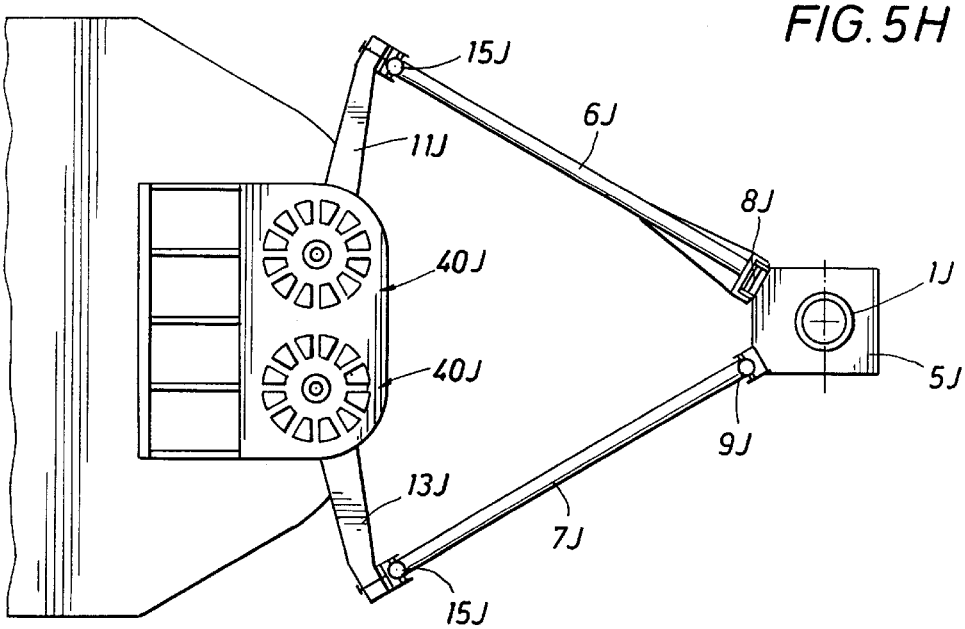
FIGS. 5G and 5H are side and plan views of an alternative construction with elastomeric torque springs coupled between the vessel and a torque arm, with FIGS. 5I and 5J showing a torque drum diaphragm arrangement coupled to the torque arm, with sections along lines 5J—5J(A) and 5J—5J(B) of FIG. 5I and a partial top view presented in FIG. 5J.
Figure 5G:
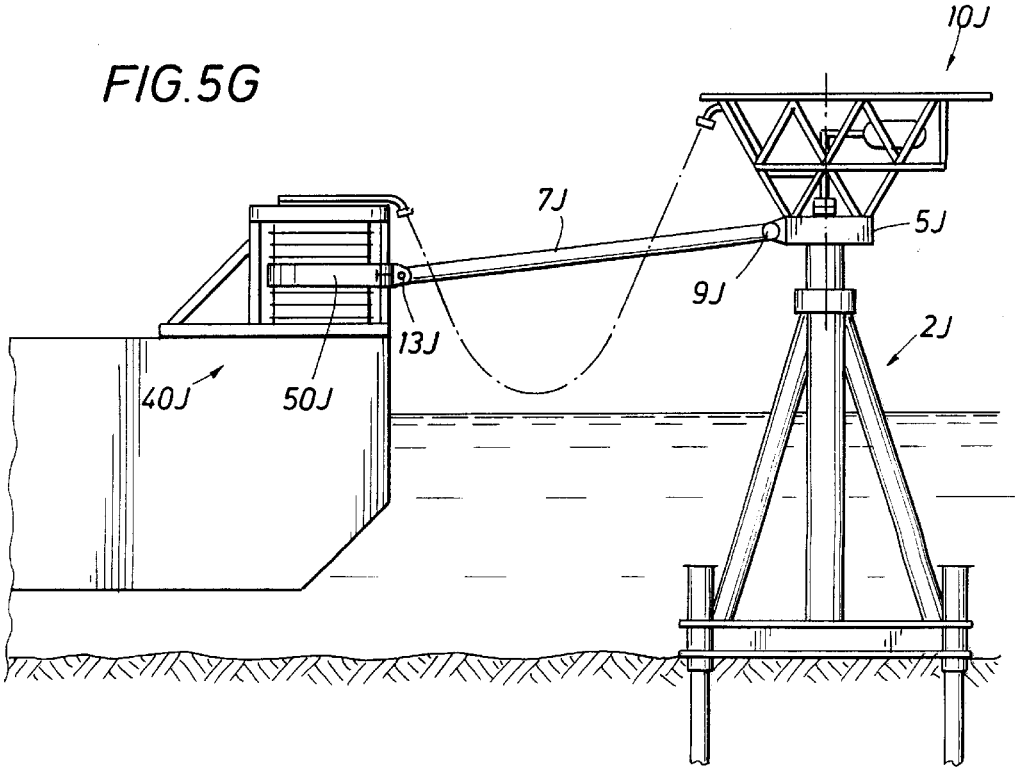

Another version of the elastomeric torque spring arrangement 40A is shown in FIGS. 5E and 5F where the restoring shear forces act on both sides of a torque diaphragm 50A providing a "Dual Plane Shear Load Arrangement". In essence, the spring arrangements of FIGS. 5C and 5D and of FIGS. 5E and 5F are analogous to single and double shear planes in bolted shear connections.

The Dual Plane Shear Load Arrangement of FIGS. 5E, 5F makes it possible to provide a given torque resistance with a smaller torque radius than is required for a Single Plane Shear Load Arrangement. However, the primary advantage of the Dual Plane Shear Load Arrangement of FIGS. 5E and 5F is that its design makes it practical to provide a vertical compressive loading on the shear fender units 39. As discussed below, a compressive loading enhances the fatigue endurance of the shear fender units 39, and is believed to be beneficial for the motion damping effect of these units.

A Dual Plane Shear Load Arrangement could be more expensive to construct than a Single Plane Shear Load Arrangement and it may be more economical to satisfy fatigue requirements by designing a Single Plane Shear Load Arrangement like FIGS. 5C and 5D for smaller peak shear distortion angles by providing additional rows of shear fender units with more units per row, or simply larger shear fender units.

One section on Rubber Springs of technical reference book, *Harris & Crede, Shock and Vibration Handbook Table* 35.5 indicates that the fatigue life of elastomeric units subject to cyclic shear strains of moderate magnitude can be much improved by applying lateral compression loads to the shear units. According to the tabulated data, lateral loads causing compressive strains of 12.5% may increase fatigue life by a factor of two or more.

For the motion damped torque arm mooring systems of FIGS. 5C, 5D, 5E and 5F, in order to produce a 12.5% compressive strain, a compressive load of approximately 75 tons is necessary on each fender unit, or a total system load in the order of 2000–2500 tons. Nevertheless, an optimum loading may be in the order of 1000 tons. This loading would limit the compressive strain to approximately 6%, and may well be nearly as effective as a 12.5% strain in enhancing the fatigue endurance of the shear fender units. Compressive loading is believed to be beneficial for the motion damping effects of the shear fender units 39.

A simple way of providing compressive loading on a single plane shear load arrangement, of FIG. 5C, could be to place heavy blocks of high density concrete on top of the torque diaphragm 50. However, to provide 1000 tons of ballast weight, for a 6% compressive strain, would require that the high-density blocks be stacked to a height of approximately 4 m on top of the 3 m high shear fender assembly 40. Such an arrangement could be awkward and rather impractical.

The Dual Plane Shear Load Arrangement of FIGS. 5E and 5F is ideally suited for providing adequate compressive loading of the shear fenders 39 of the elastomeric shear rings 41 through the use of hydraulic jacking units. A number of short stroke hydraulic rams 70 are inserted through hydraulic cylinder wells 74 between the upper radial framing members 72 of the shaft support structure and a compression load distribution ring 76 on top of the upper elastomeric shear ring 41. Shear keys 79 between the load distribution ring 76 and the radial arms 73 of radial frame members 72 prevent relative radial motion but allow relative vertical movement between ring 76 and arms 73. The upper radial framing arms 73 of the upper radial frame member 72 are coupled to the lower most shear plane stiffening ring 46A and the vessel by posts 77.

The hydraulic rams 74 are pressurized simultaneously from a single pressure source. When pressurized, the rams place the stacked elastomeric shear units 39 in compression by squeezing the shear units 39 between the compression load distribution ring 76 and the vessel. As in the FIGS. 5C and 5D embodiments, the stacked elastomeric shear units, are coupled to torque shaft 42 and torque arm 13E via torque diaphragm 50A. The arrangement of FIGS. 5E and 5F can be sized to provide any desired level of compressive loading of the fender units.

The elastomeric torque spring arrangements described above all have the elastomeric torque spring assemblies mounted on top of a base structure with the torque arms located at a lower level. Such designs are particularly suitable for installation on a conventional tanker bow, which usually has a relatively high forepeak. The torque arm can be fitted into the hull structure, with the bottom of the torque spring assemblies at the forecastle deck level. (See especially FIG. 5A.) The lower level location of the torque arms results in lower height requirements for the mooring tower and in lower overturning moments on the tower. This in turn, translates into lower costs for the tower structure and anchor pile requirements.

Figure 5I:
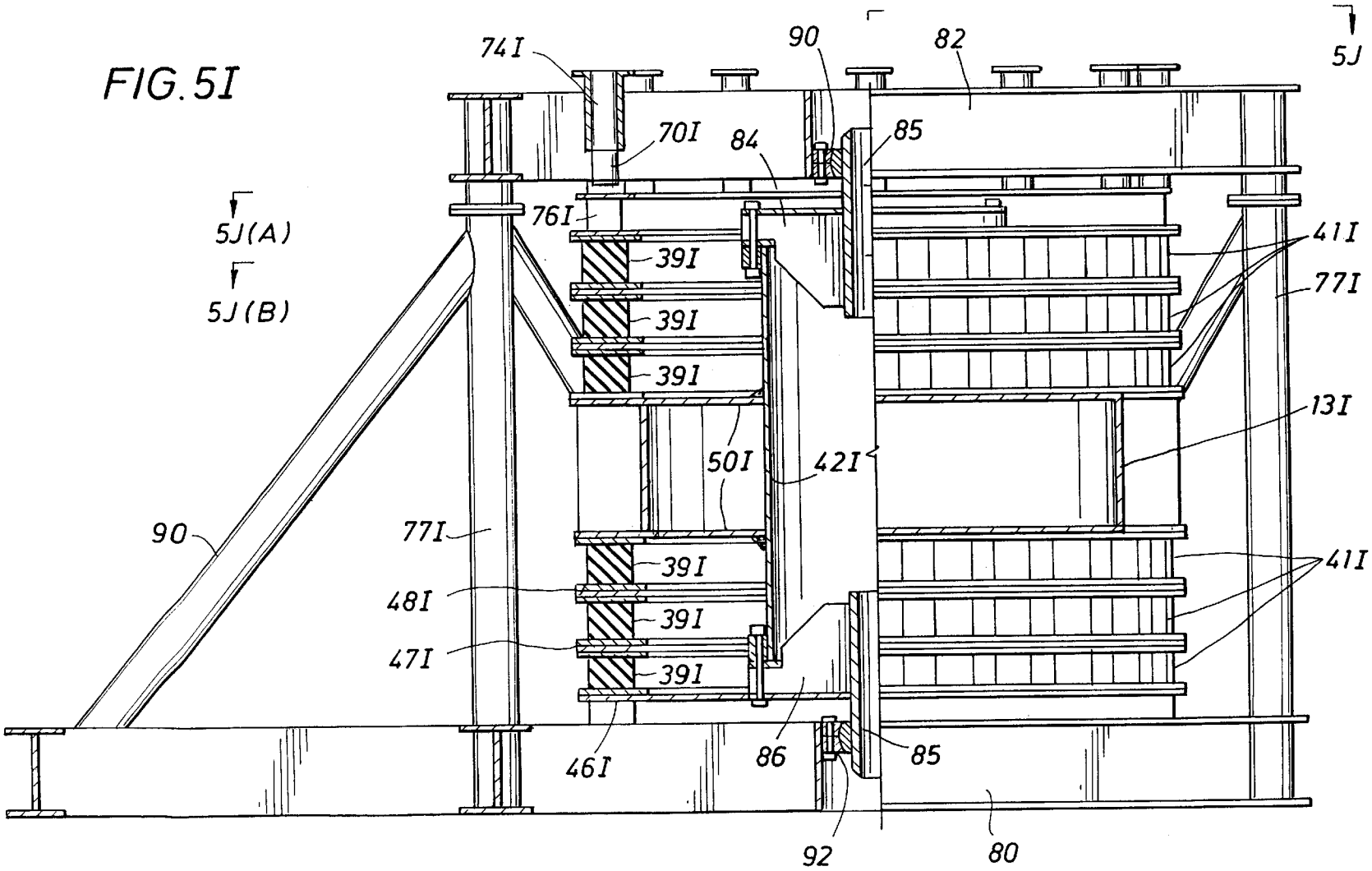
FIGS. 5K and 5L are side and top views of an alternative construction with elastomeric torque springs coupled between the vessel and a torque arm, with FIGS. 5M, 5N and 5O showing a single torque diaphragm with the shear units arranged in an open circular arch pattern, with FIG. M showing a top view and sections along lines 5M—5M(A) and 5M—5M(B) in FIG. 5N and FIG. 5O showing sectional view along lines B—B of FIG. 5M.
FIG. 5P is a cross-section of an alternative elastomeric torque spring with direct connection of the torque arm to a diaphragm drum of the spring.
FIGS. 5Q, 5R and 5S are section views from section lines of FIG. 5P showing alternative arrangements of elastomeric units to minimize sloping of the torque arm at its connection to the elastomeric torque spring and to prevent movement of the torque arm rotation center while the torque arm responds to varying yoke forces.
Figure 5J:
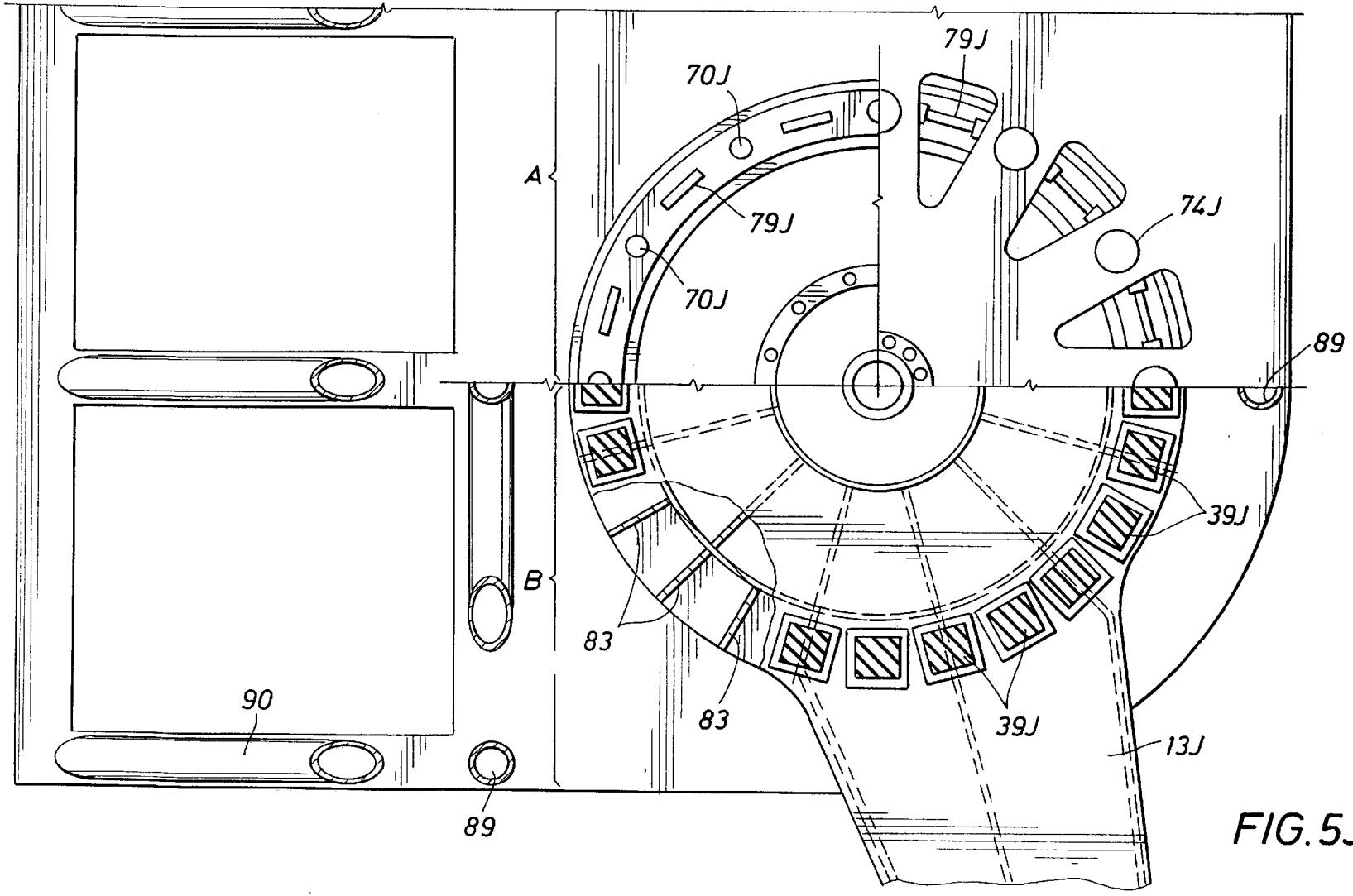
Figure 5L:
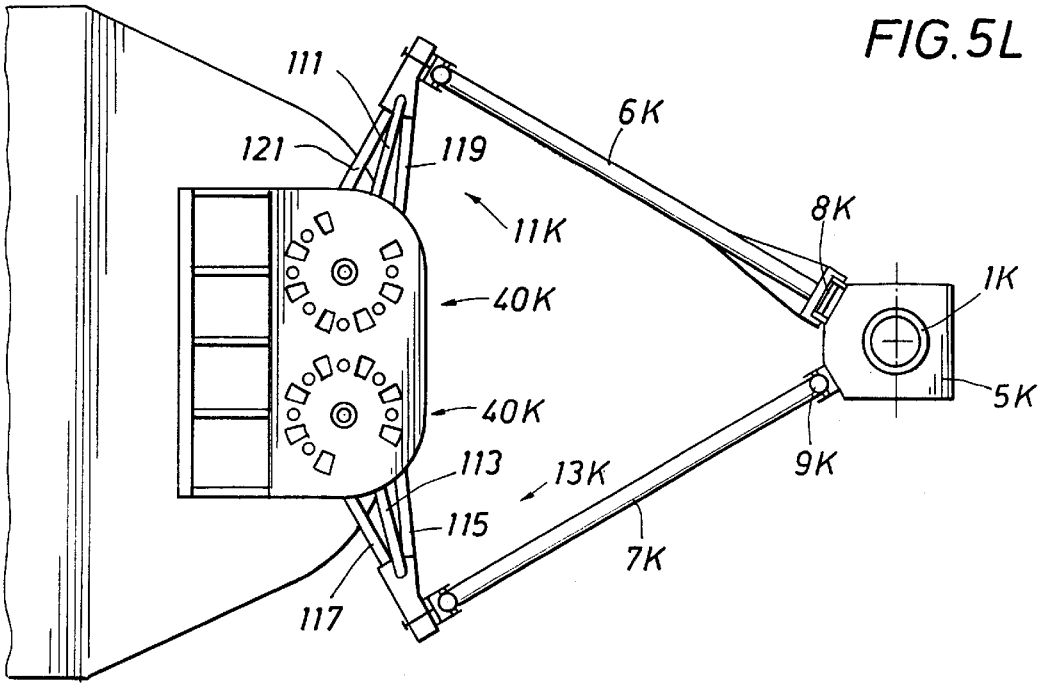
Figure 5K:
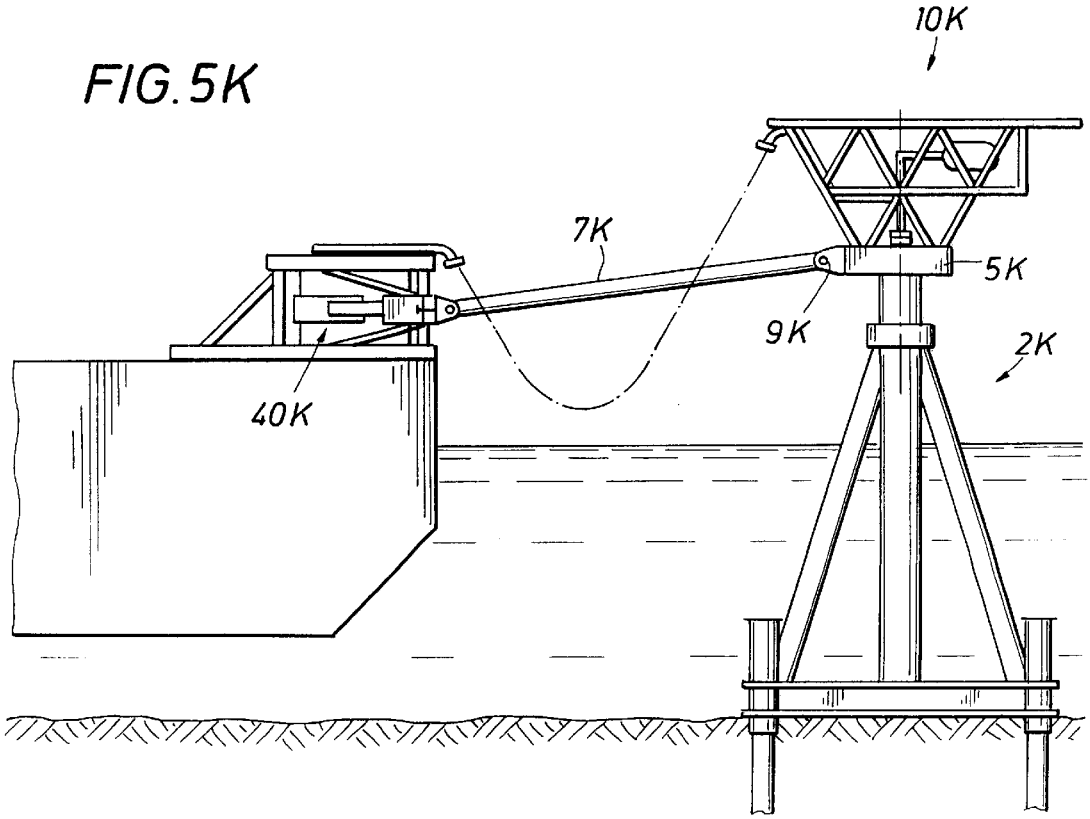

An alternative design version from that of FIGS. 5E and 5F is illustrated in FIGS. 5G, 5H, 5I and 5J. The shear fender 39 arrangement of the elastomeric shear unit arrays 41I and the hydraulic jacking system for applying compressive loading on the shear fenders 39 of the shear unit arrays 411 of FIGS. 5G–5J is substantially identical to the design of FIGS. 5E and 5F. However, the design of the torque diaphragm is changed from single stiffened plates to torque drums 50I made integral with the torque arms 13J (11J). The top and bottom drum diaphragms 50I are spaced a distance equal to the height of the torque arms 13J (and 11J), and are fixed to the vertical center shaft 42I. Torque drum stiffeners 83 are provided as illustrated in FIG. 5J between top and bottom drum diaphragms 50I.

The torque arm support frame of FIGS. 5B and 5I includes a lower support base 80 and an upper support deck 82, interconnected with tubular columns 77I and diagonal bracing 90. Both the lower support base 80 and the upper support deck 82 are welded steel plate box structures with internal stiffening webs. The vertical center shaft 42I is fitted with bolted-on bearing pin units 84, 86 for pins 85, which are supported in self-lubricating bearing sleeves in the base 80 and upper deck 82 structures. Radial bearings 90, 92 provide radial bearing support between pins 85 and upper support deck 82 and lower support deck 80. This arrangement results in a more compact design than the designs described in FIGS. 5A, 5B or 5C, 5D. Thus, rotation of torque arm 13J, center shaft 42I, and pin 85 is resisted by the upper and lower stacks of elastomeric shear unit arrays 41I, which are coupled at a top end via the compressive load distribution ring 76I and to the upper support deck 82 and at a bottom end to the lower support base 80.

Another alternative version of the invention to that shown in FIGS. 5E, 5F and 5G–5J is illustrated in FIGS. 5K, 5L, 5M, 5N, 5O. Instead of having dual diaphragms (top and bottom rings of the torque drum) of FIGS. 5G–5J, with shear fenders 39 of an elastomeric shear unit array arranged in a closed circular pattern, the torsion spring device of FIGS. 5K–5O has a single torque diaphragm 50 N (see FIG. 5N) with the shear units 39 arranged in an open circular arch pattern 141. (See FIGS. 5L and 5M).

Figure 5M:
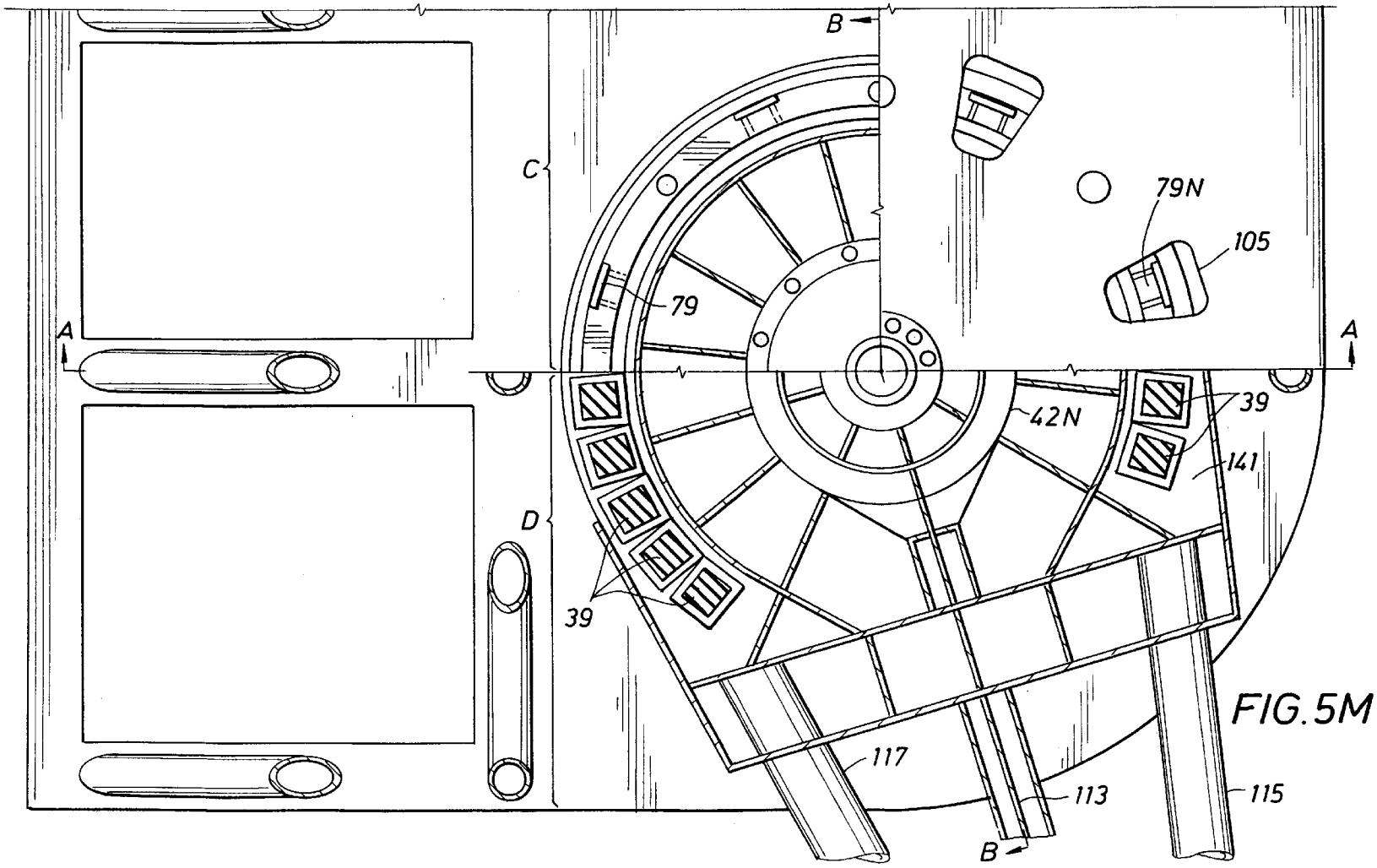

Referring especially to FIG. 5M, the open side of the shear fender arch leaves space for tapered steel plate support beams 111, 113, counterlevered out from the center shaft 42N, each of which in turn supports two tubular torque arm struts. Support beam 113 supports struts 115, 117 of torque arm 13K and support beam 111 supports struts 119, 121 of torque arm 11K extending from the edge of a respective diaphragm 50N to the outer end of the support girder.

Figure 5N:
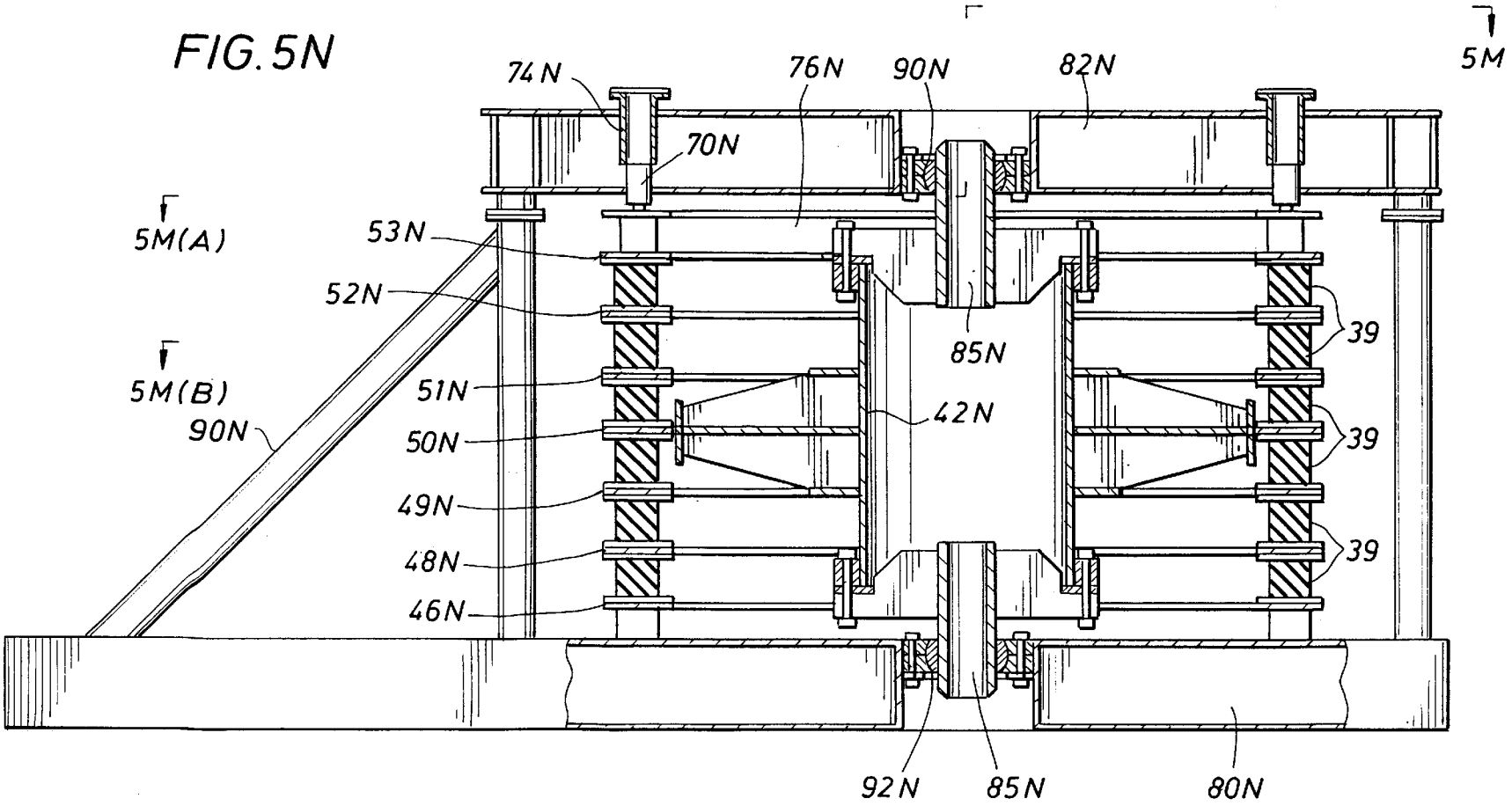
Figure 50:
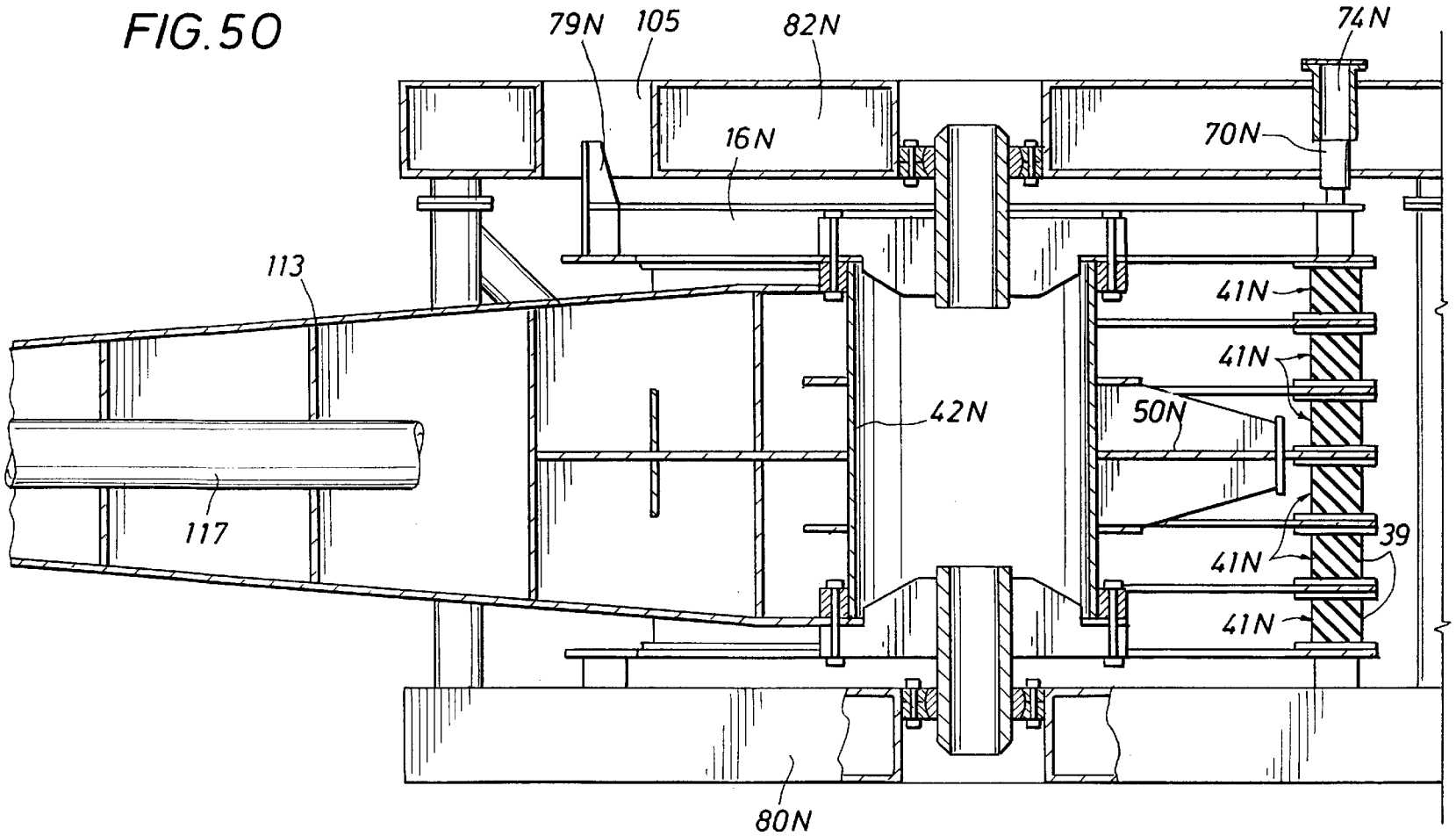

FIG. 5N shows a section through lines A—A of FIG. 5M, while FIG. 5O shows a section through lines B—B of FIG. 5M. FIG. 5O illustrates support beams 113, which extend from top and bottom positions of stacked elastomeric shear unit arrays 41N while torque arm strut 117 extends outwardly from torque diaphragm 50N. Shear keys 79N of compression ring 76N are illustrated in the section view of FIG. 5O positioned in shear key well 105 of upper support deck 82N.

The torque arm arrangement illustrated in FIGS. 5K–5O results in a lower total height of the torque arm module and may be more economical than the torque drum and box type torque arm struts of FIGS. 5G–5J.

Figure 5P:
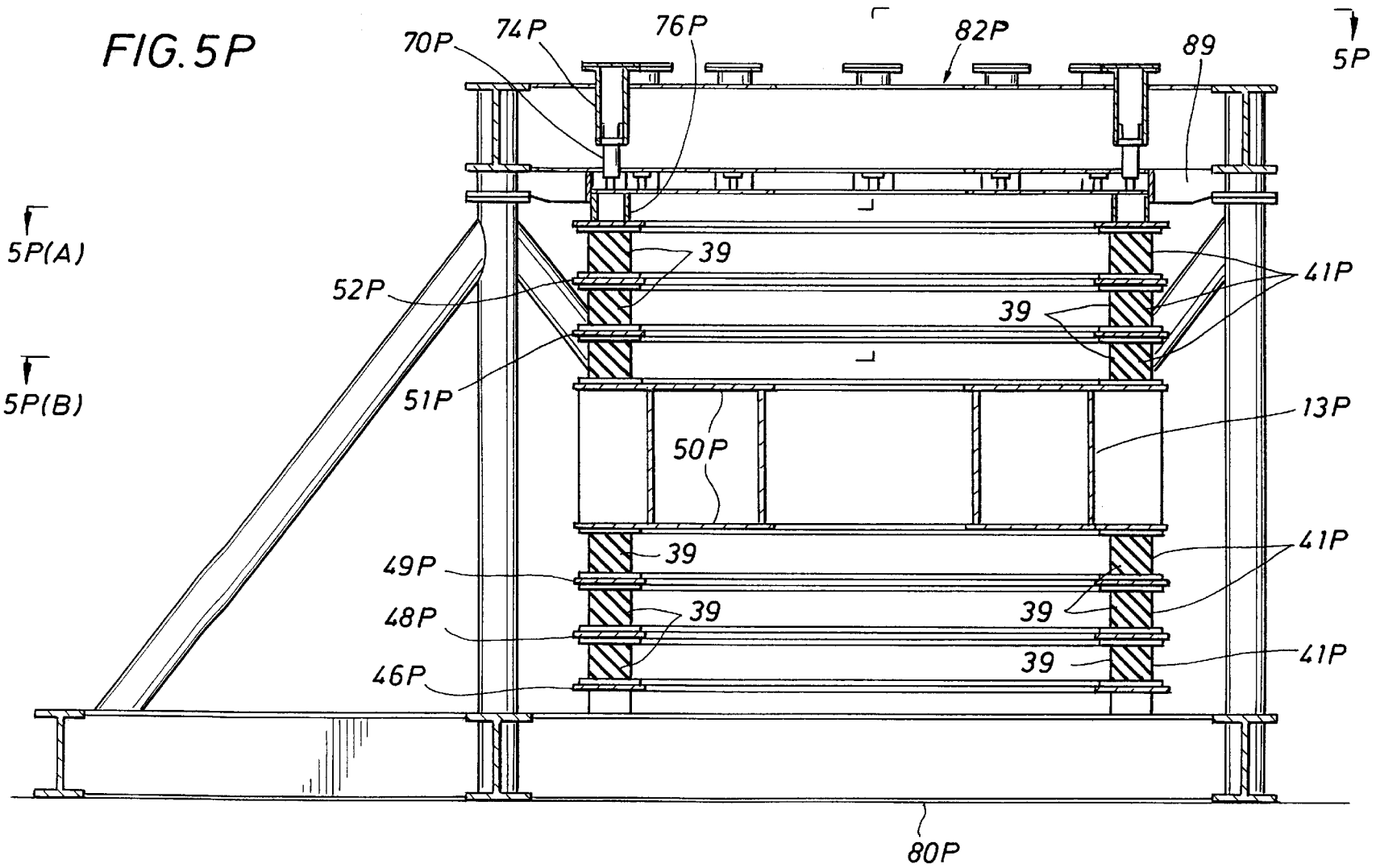

Alternative 3A—Elastomeric Torsion Spring Assembly With Above-Water Yoke: Direct Connection of Torque Arm to Elastomeric Torque Spring Assembly FIGS. 5P, 5O, 5R, 5S The elastomeric torque spring assemblies 40A of FIG. 5E, 40J of FIG. 5I and 40K of FIG. 5N can be modified by omitting the center shaft and bearing arrangements in the torque arm module. A modified arrangement is illustrated in FIGS. 5P, 5Q, 5R, and 5S where a cantilevered torque arm box structure is supported only by being resiliently fixed between upper and lower shear fender arrays. The "clamping" action provided by the compression rams in the upper support deck enhances the stability of the arrangement. FIG. 5P is a vertical section of an alternative or modified torque arm module which is essentially identical for the three alternative shear fender layouts of FIGS. 5Q, 5R, and 5S.

Figure 5Q:
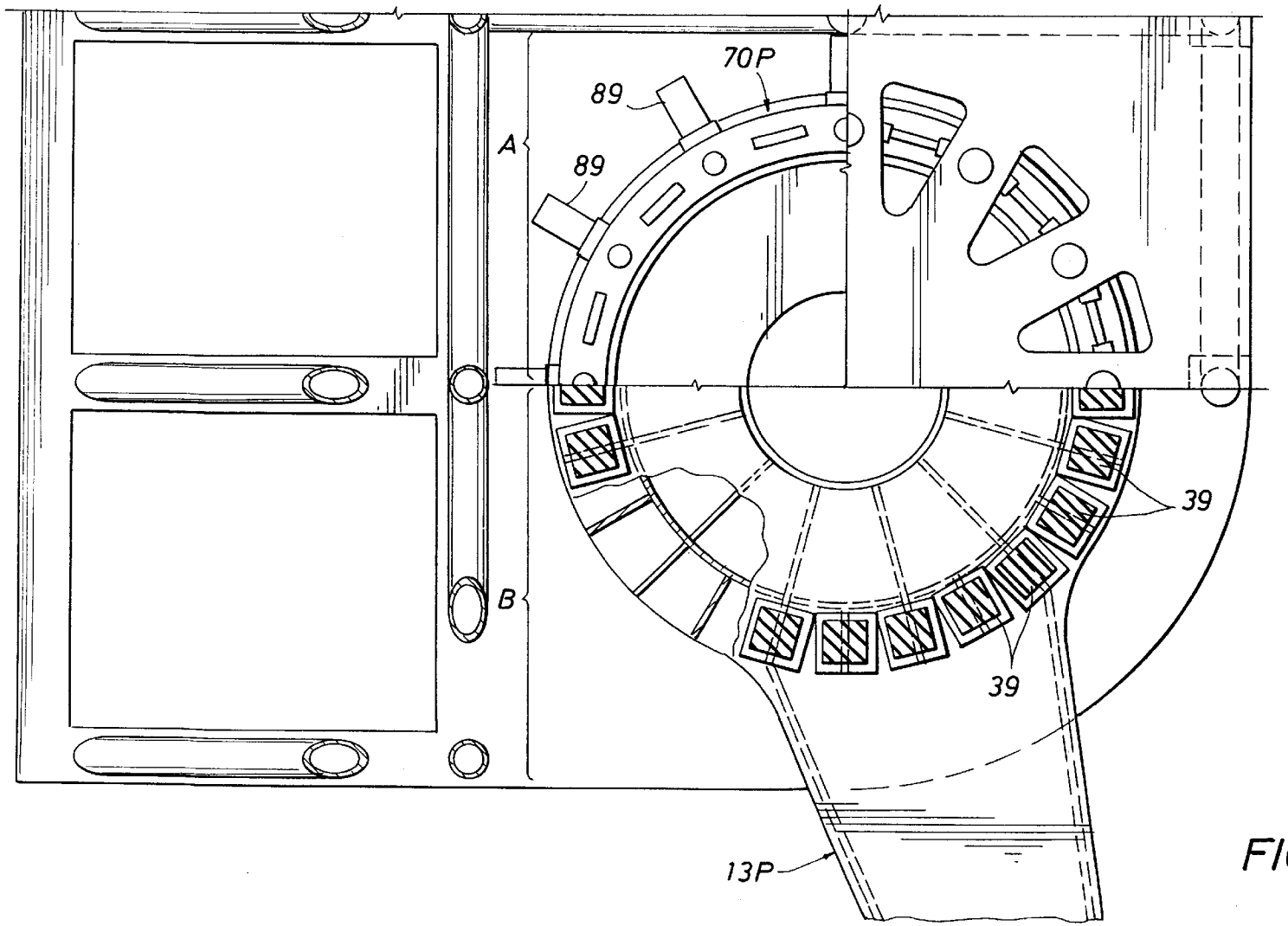

The shear fender arrangement of FIG. 5Q is substantially identical to the arrangement provided in FIG. 5J which includes a center shaft torque arm support, but in the arrangement of FIGS. 5P and 5Q, the center shaft and its bearings are removed, with lateral loads previously taken by the center shaft bearings now transferred in the modified arrangement to the shear fender units 39. This causes a lateral shear distortion of the shear fender units 39 in response to mooring loads and a corresponding offset of the torque arm rotation center in the direction of the yoke arm forces. The lateral shear distortion will occur simultaneously with the tangential shear distortion due to the rotation of the torque arm.

The compression load distribution ring 70P under the upper support deck 82P is exposed to tangential loads only for the alternatives of FIGS. 5E, 5I, and 5N. With the center shaft removed as in FIGS. 5P and 5Q, the load distribution ring 76P is exposed to lateral loads and must be supported laterally by radial thrust brackets 89 fixed to the frame under the upper deck 82P. Twelve radial thrust brackets 89 are preferred around the periphery of load distribution ring 76P.

Six elastomeric shear unit arrays 41P are illustrated in FIG. 5P, with 24 PAULSTRA fender units (elastomeric blocks) per array, for example.

The weight of the yoke arm and the vertical components of the yoke arm forces, as well as the weight of the cantilevered torque arm 13P itself, causes a vertical cantilever moment, which is counteracted by the center shaft and bearings of the alternatives described above. With the center shaft removed, the cantilever moment must be counteracted by the clamping action of the compressive load on the shear fender units. This cantilever moment causes the clamping faces and the torque arm to slope downward. However, laminated fender units 39 support large compressive loads with relatively small deflections. Compressive deflection of the fender units 39 and the resulting downward sloping of torque arm 13P can be reduced by increasing the number of steel plate laminations in the fender units 39.

Figure 5R:
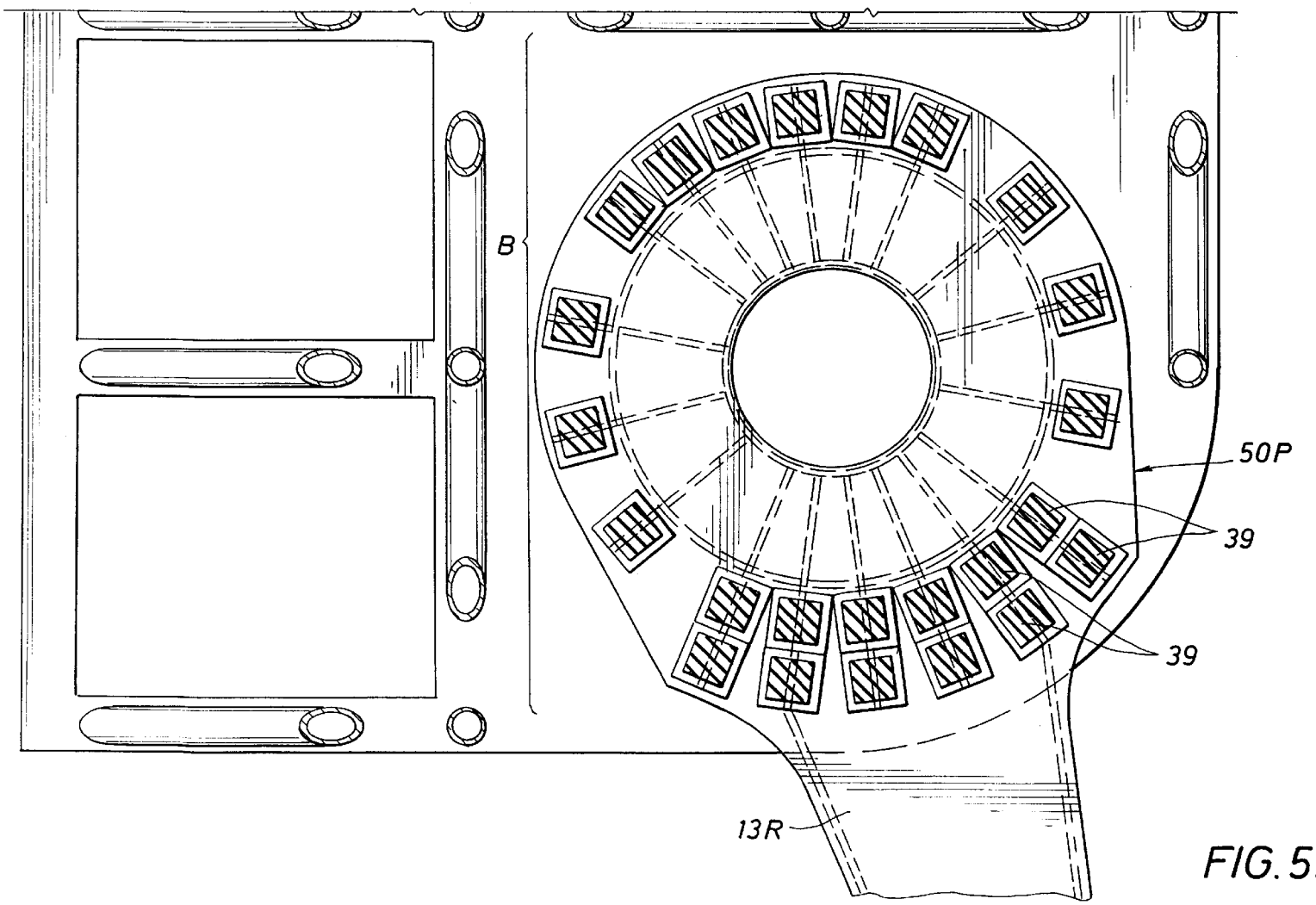

An alternative distribution of shear fender units 39 around the shear fender circle is illustrated in FIG. 5R to minimize the lateral movement of the torque arm 13R rotation center in response to varying mooring loads. With proper sizing and distribution of the fender units 39, the torque arm 13R rotation center remains essentially stationary under all load conditions.

The shear fender 39 arrangement of FIG. 5R uses the same number of PAULSTRA fender units as used in the arrangement of FIG. Q. However, of the total of, for example, 24 shear fender units 39, in each shear fender array 41P, six shear fender units 39 are moved into a second row on the outboard side of the shear fender circle. A "free body" analysis of the forces acting on the torque arm 13R reveals that for any yoke arm force applied at the end of the torque arm (e.g., applied essentially perpendicularly to the torque arm 13R axis), the corresponding perpendicular components of the tangential torque forces will balance the yoke arm force. Consequently, the torque arm rotation center remains essentially stationary while the torque arm 13R responds to varying yoke arm forces.

Figure 5S:
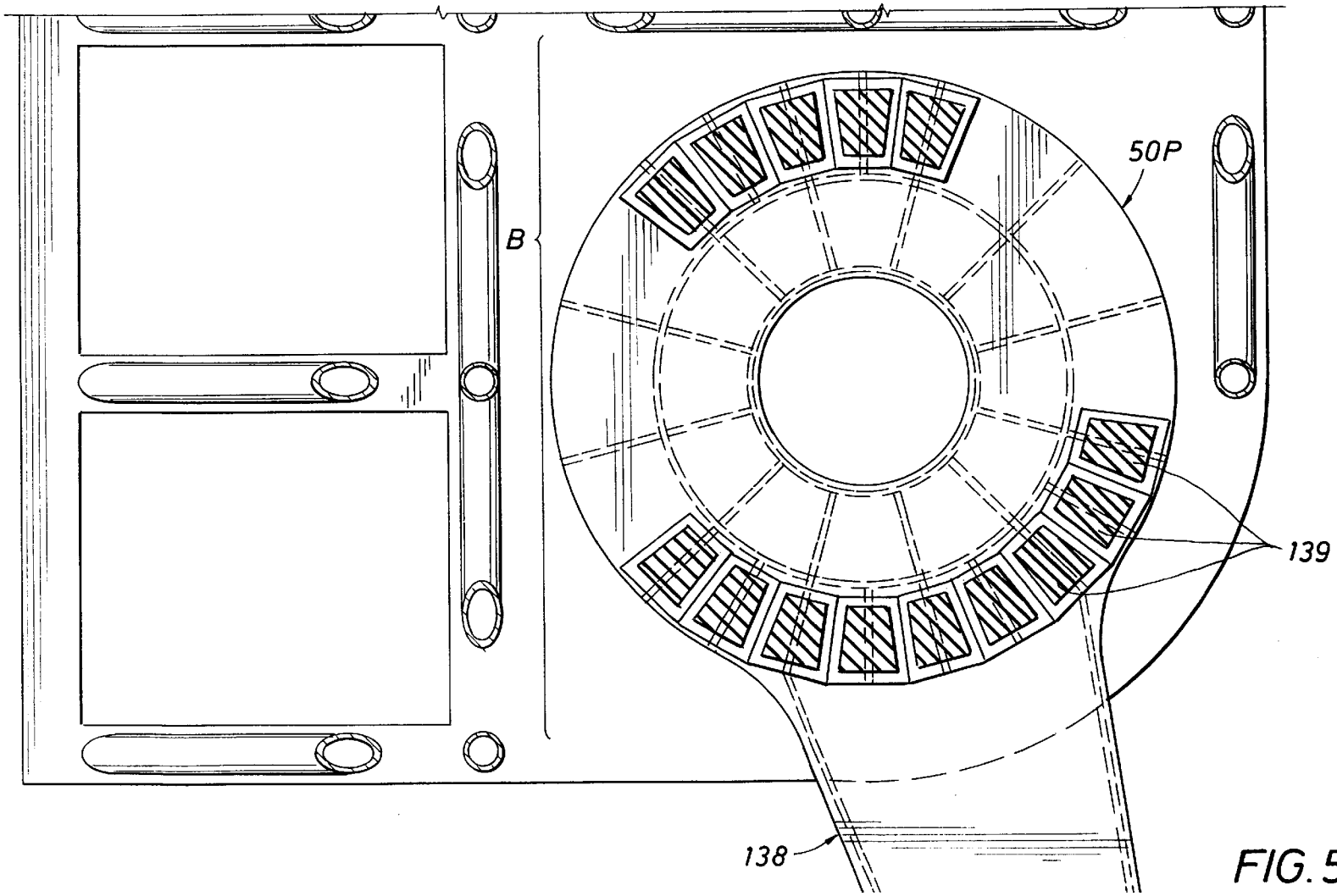

FIG. 5S shows an arrangement of fender units similar to that of FIG. 5Q, but special fender units 39 are arranged to achieve the same stabilizing results as the arrangement of FIG. 5R. Instead of 24 (for example) standard fender units of rectangular shape, in each of the six shear fender layers 41 (see FIG. 5P), a total of, fourteen units 139 of trapezoid shape are provided in each array. An advantage of the arrangement of FIG. 5S is the concentration of the shear fender units 139 on the inboard and outboard side of the torque circle. This arrangement provides a maximum resistance to the downward sloping of the torque arm due to the weight of the cantilevered torque arm and the vertical forces acting on the outboard end of the torque arm.

Alternative 4—Elastomer Torque Spring Assembly with Submerged Yoke—FIGS. 6A, 6B, 6C Elastomer Torque Springs Assembly v.w/Submerged Yoke The elastomeric torque spring concept may also be adapted for use with submerged yoke arms 600, 700, as shown in FIGS. 6A, 6B and 6C. However, the advantage of having a single prefabricated module to be fitted into the vessel bow is lost with this arrangement. A lower support bracket 750 for torque shafts 120 at the keel level of the vessel and an upper support bracket 760 at the foredeck level of the vessel must also be provided. A personnel and supply transfer crane 470 must also be provided.

Fatigue Analysis

Fatigue effects, both on the high strength steel torsion shaft system of Alternatives 1 and 2 and on the elastomeric shear unit system of Alternatives 3 and 4, are controlled in part by appropriate design of the components.

For the torsion shaft system of Alternatives 1 and 2, fatigue effects may be reduced by increasing the wall thickness of the torque shafts and adding more nested shafts to maintain the flexibility.

For the elastomeric shear unit system of Alternatives 3 and 4, fatigue effects may be reduced by adding more shear unit arrays and more fender units in each array; increasing both the diameter and the height of the torque spring assembly, and as described above, by applying compressive load to the elastomeric fender units or blocks of elastomeric material of the system.

Horizontal Mounting of Torsion Shafts

The vertically aligned torsion shafts described above for Alternatives 1 and 2 can also be mounted in a horizontal position. Alternatives 5–9 are described below with that feature.

With the torsion shaft assemblies mounted horizontally, the torque arms are oriented vertically, and both the torque arms and the torsion shafts are subject to large lateral bending moments due to the port and starboard directed components of the yoke arm forces. This is particularly significant for cross current sea conditions.

The torsion shafts nested inside each other must be supported individually to prevent deflection out of their coaxial alignment. The support arrangement is designed to allow free and independent rotation of each end connection ring about the shaft axis.

For systems with both the horizontal torsion shafts and the yoke arms above water, the torsion shafts must be mounted on an elevated superstructure above the forecastle deck, in a similar manner as for prior art above-water yoke mooring system with suspended counterweights.

Horizontal torsion shaft systems can be arranged in a number of ways. Five different versions are described below as Alternatives 5–9.

Alternative 5—In-line Horizontal Torsion Shafts with Above-Water Yoke Arms—FIGS. 7A, 7B, 7C, 8

In this alternative, illustrated in FIGS. 7A, 7B, 7C and 8, the torsion shaft assemblies 801, 802, corresponding to the port and starboard yoke arms 803, 804, are mounted in-line as illustrated in FIG. 7B. Other aspects of the tower yoke arms are substantially the same as the arrangement of FIGS. 1A–1C. This results in a symmetrical arrangement, but the length of each torsion shaft assembly 801, 802 is limited to about half of the beam width of the vessel. Limited shaft length can be compensated for by using an adequate number of nested shafts in the assembly. Generally it is desirable that each torsion shaft assembly 801, 802 be as long as possible, so that the number of nested shafts in each assembly can be reduced to a minimum.

The torsion shaft assemblies are mounted on an elevated support frame 810 above the forecastle deck 809, with the torque arms 806, 807 extending downward on each side of the vessel to locate the tri-axial yoke arm U-joints 811, 812 at a suitable elevation.

Figure 8:
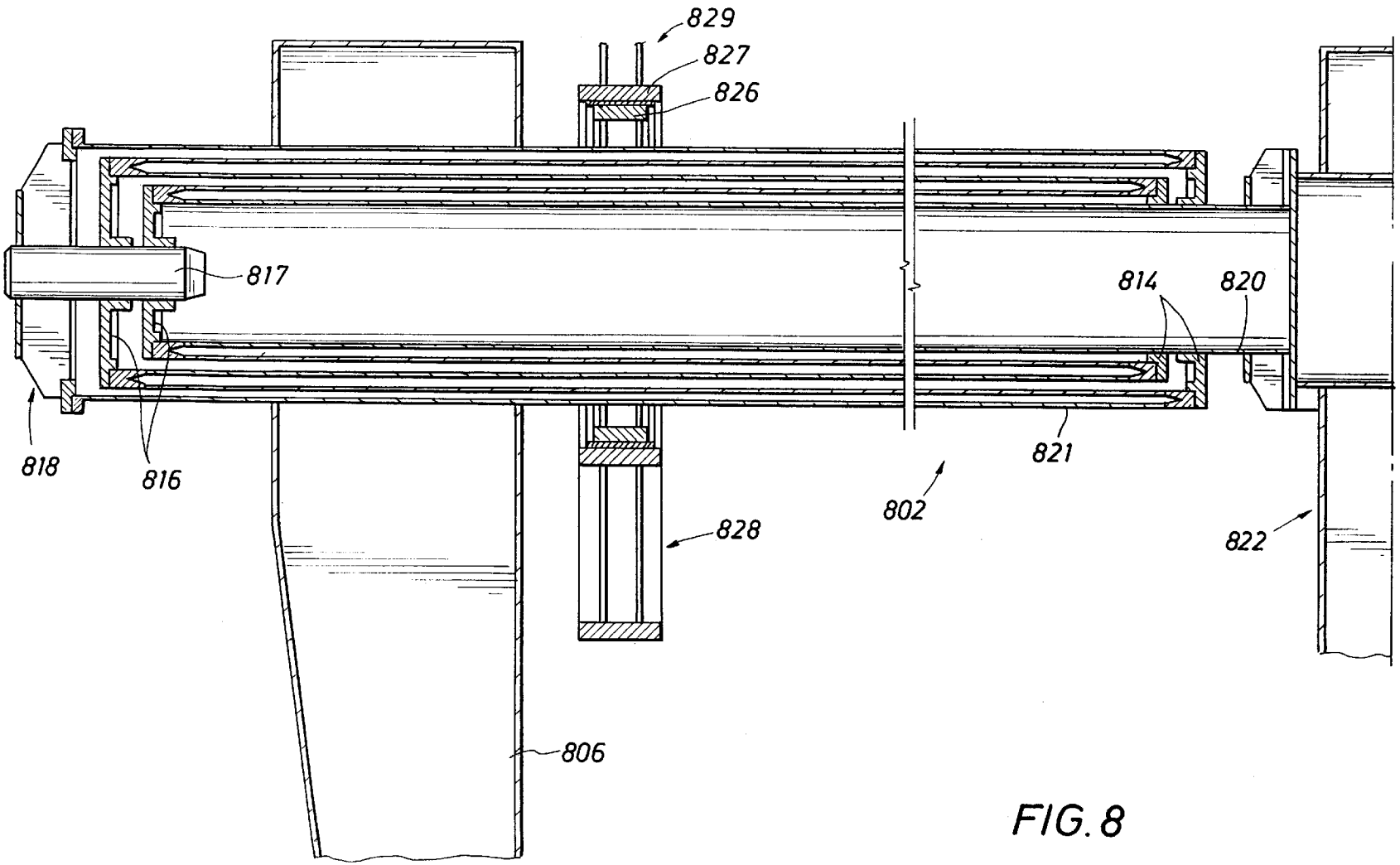
FIG. 8 is a detailed end sectional view of a horizontal torsion shaft assembly of FIGS. 7A, 7B and 7C.
Figure 12:
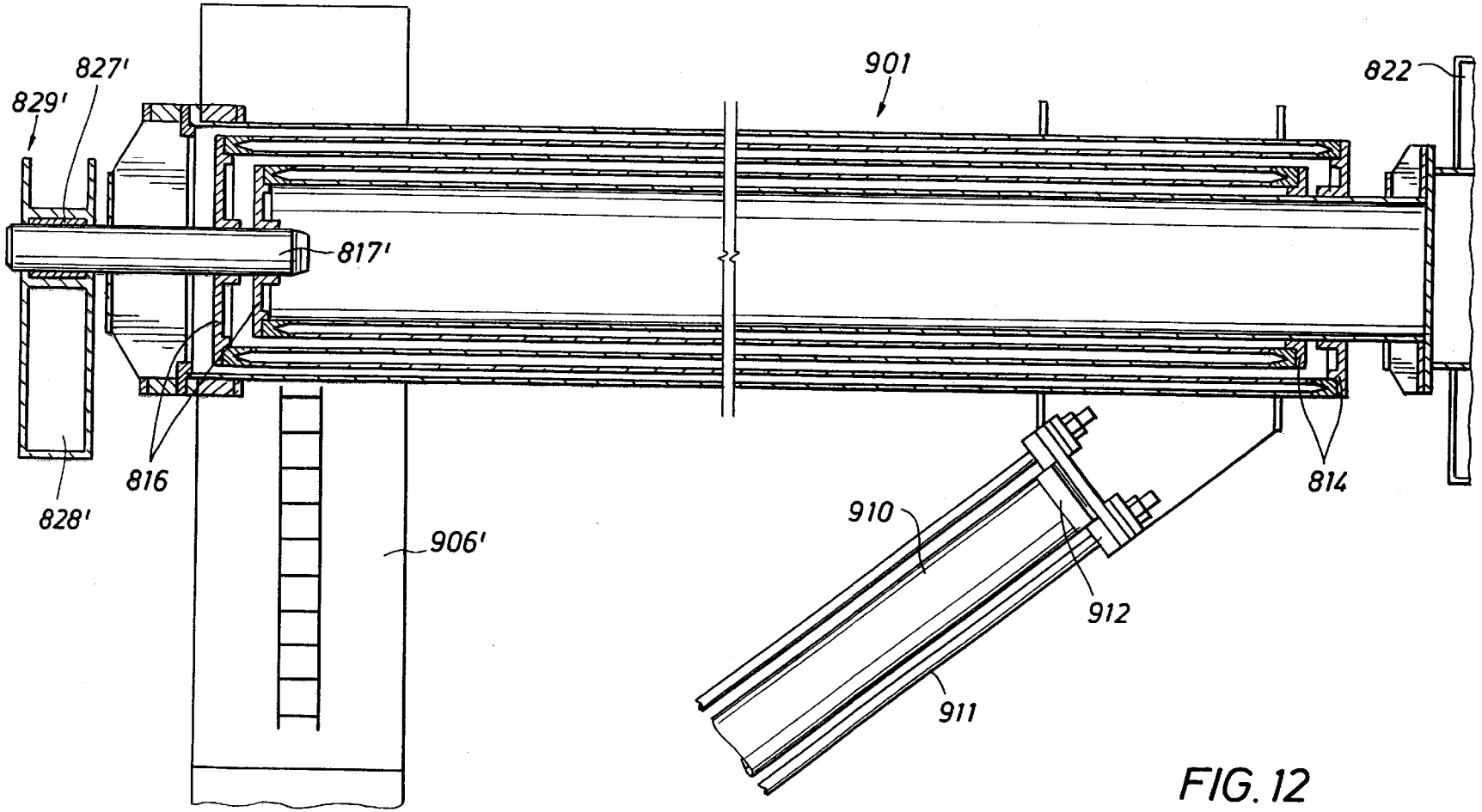
FIG. 12 is a detailed end sectional view of a horizontal tension spring shaft assembly of FIGS. 11A, 11B and 11C.

FIG. 8 shows basic details of the horizontal torsion shaft assembly 802. Each end of the individual shafts is supported on rotating spacer rings 814, 816. Rings 814 are split rings. At the outboard end of the assembly, the spacer rings 816 rotate about a large bearing pin 817 fitted into an end closure 818. At the other end, the innermost torsion shaft tube 820 is fixed to an abutment 822 located on the vessel centerline, and the remaining shafts are supported on split spacer rings bearing 824 against the fixed shaft end.

The main shaft support bearing at the outer end of the support frame has a bearing journal 826 with somewhat larger diameter than the diameter of the outer torsion shaft tube 821. The journal runs in a split self-lubricating bushing 827 seated in a pillow block arrangement with the bottom cup recessed into the support beam 828. A bearing clamp 829 secures the bearing 826 to the support beam 828.

Lateral loads on the vertical torque arms 806, 807 result in relatively large bending moments in the torque arm and the outer torsion shaft tube 821. The wall thickness of the outer tube in the region near the support bearing is primarily governed by this bending moment.

Personnel access to the mooring tower is provided via ladders and a walkway (not illustrated) along one of the yoke arms.

Alternative 6—Offset Horizontal Torsion Shaft with Above-Water Yoke Arms—FIGS. 9A, 9B, 9C, and 10A, 10B, 10C In this alternative embodiment illustrated by FIGS. 9A, 9B, 9C and 10A, 10B, 10C, the torsion shaft assemblies 901, 902 are offset horizontally, so each torsion shaft assembly can be almost as long as the beam width of the vessel. This is advantageous in that it is possible to achieve large yoke force capacities, while limiting the resulting torsion shear stresses to acceptable limits; or alternatively, for moderate yoke forces, so that the number of nested torsion shaft tubes required can be reduced to a minimum.

The arrangement shown in FIGS. 9A, 9B, 9C is shown with both torque arms 906, 907 vertical in the neutral, no-load, position. A shaft support frame 909 provides support with respect to the vessel for torsion shaft assemblies 901, 902. This arrangement requires that the lengths of the two yoke arms between the mooring body or tower and the ends of the torque arms be unequal. This unequal length of yoke arms is not detrimental to the performance of the system.

Alternatively, the torque arms 911, 912 may be slanted in opposite directions so that the two yoke arms may be made of equal lengths. (See FIGS. 10A, 10B, 10C.) The different inclination of the torque arms 911, 912 results in unequal vertical force reactions of the two sides of the vessel. This tends to introduce vessel roll motions also under collinear sea conditions. However such unequal vertical load components will occur in any case under crossed sea conditions for any soft-yoke mooring system.

Alternative 7—In-line Horizontal Torsion Shafts with Submerged Yoke Arms—FIGS. 11A, 11B, 11C, and FIG. 12

In a seventh alternative torque arm mooring system illustrated in FIGS. 11A, 11B, 11C and 12, the torsion shaft assemblies 901', 902' are located off the bow, at an elevation just above peak wave crest height at full draft of the vessel. A full draft position is shown in solid lines; a 42% draft position is shown in dashed lines. The torque arms 906', 907' extend underwater to submerged yoke arms, which are attached to the mooring tower turntable at a level about 10 m below the water surface. This arrangement eliminates the elevated support structure above the forecastle deck (of Alternatives 5, 6) and also reduces the structural requirements for the mooring tower, due to the much reduced tower overturning moments.

This torsion shaft arrangement 901', 902' is shown as an in-line arrangement, with the torque arms braced against lateral load components by diagonal brace 910. The end connections of the diagonal braces which includes a tie rod and rocker shoe arrangement 910, will permit resilient twisting of the torque shafts. (See FIG. 12.) The bearing journal for support of the torsion shaft assembly is in this embodiment is shown as an extension of the internal shaft support pin 817'. The journal shaft is carried on a self-lubricating bushing 827', which is fitted in a pillow block on the "outrigger" support bracket 828', off the bow of the vessel.

Personnel transfer between the moored vessel and the mooring tower is provided by a revolving crane arrangement mounted on the tanker bow, as proposed for torque arm moorings of Alternatives 2 and 4 as described above.

The in-line torsion shaft arrangement shown on FIG. 11B could be replaced by an offset shaft arrangement as shown in FIGS. 10A, 10B, 10C, permitting a doubling of the length of the torsion shaft assemblies.

Alternative 8—Offset Horizontal Torsion Shafts with Submerged Yoke Arms—FIGS. 13A, 13B, 13C, 14

Figure 14:
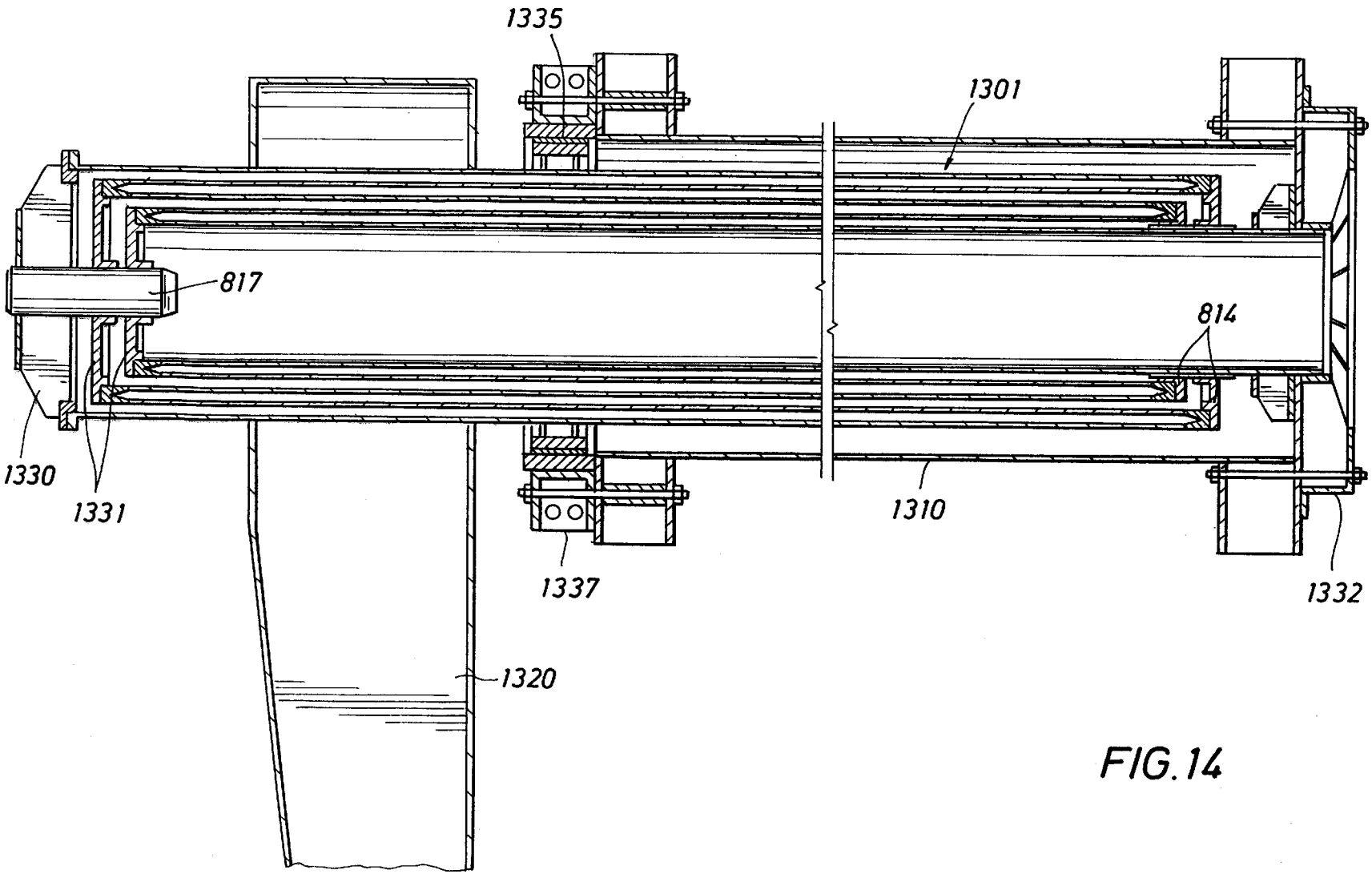
FIG. 14 is a detailed end sectional view of a horizontal tension spring shaft assembly of FIGS. 13A, 13B and 13C.

In an eighth alternative arrangement of FIGS. 13A, 13B, 13C, and 14, each torsion shaft assembly 1301, 1302 is mounted in a support casing 1310, which in turn is installed in the bow hull structure below the forecastle deck. The support casing 1310 supports a bearing assembly with self lubricating bushing 1335 held in place with a split support ring with clamping bolts 1337. Torque arms 1320, 1322 extend downward to submerged yoke arms 1324, 1326, as for the Alternative 7 torque arm mooring system. End closing devices 1330, 1332 are provided as illustrated in FIG. 14.

This eighth alternative arrangement is advantageous in that a robust and compact appearance is provided without awkward brackets extending from the vessel bow.

Alternative 9—Submerged Horizontal Torsion Shafts with Above-Water Yoke Arms FIGS. 15A, 15B, 15C The torque shaft and yoke arm components of a ninth alternative arrangement illustrated in FIGS. 15A, 15B, 15C are identical to the components of the eighth alternative arrangement, but are installed with the torsion shaft assemblies 1350 submerged and with the torque arms 1360, 1362 extending upward to yoke arms 1364, 1366, which are above water.

This alternative arrangement provides a cleaner design appearance for an above-water yoke system as compared to systems supported on an elevated structure above the forecastle deck.

A transfer platform, extending out from the bow hull on the port or starboard side, at a level slightly above the top of the torque arm can be provided for access to a walkway mounted along the corresponding yoke arm. This allows personnel transfer between the vessel and the mooring tower.

Alternative 10—Elastomeric Torque Spring Systems with Horizontal Rotation Axis It is possible to mount an elastomeric torque spring arrangement with a horizontal rotation axis, instead of the vertical axis alignment proposed for the Torque Spring Mooring Systems shown above in the third and fourth alternatives described above. However, a horizontal axis alignment may not provide performance aspects as desirable as the vertical axis alignment. A horizontal axis alignment may also not be as practical for convenient inspection and maintenance of system component parts.

While preferred embodiments of the present invention have been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A mooring system for a vessel comprising, a mooring body coupled to a seabed, first and second yoke arms having first and second ends with respective first ends rotatably coupled to said mooring body, first and second torque arms having first and second ends with said second ends of said torque arms coupled to respective second ends of said first and second yoke arms, and first and second torsion spring devices respectively connected between said first ends of said torque arms and said vessel, wherein said first and second torsion spring devices are arranged and designed to produce torsion forces between said vessel and said torque arms of a level required to maintain said vessel about an equilibrium position with respect to said mooring body under moderate to severe environmental conditions.

2. The mooring system of claim 1 wherein, said mooring body is a tower having a base secured to said seabed.

3. The mooring system of claim 1 wherein, said mooring body is a buoy substantially fixed to said seabed by means of anchor legs.

4. The mooring system of claim 1 wherein, each of said torsion spring devices comprises a plurality of nested tubular shafts which are coupled end to end to each other in a coaxial array.

5. The mooring system of claim 1 further comprising, a rotatable frame mounted for three hundred sixty degree rotation on said mooring body, and wherein one torque arm of said first and second torque arms is coupled to said rotatable frame by a single axis hinge and a second torque arm of said first and second torque arms is coupled to said rotatable frame by a dual axis U-Joint.

6. The mooring system of claim 1, wherein, said second ends of said torque arms are respectively coupled with said second ends of said yoke arms by tri-axial U-Joints.

7. The mooring system of claim 4, wherein, said plurality of tubular shafts are arranged in said nested array such that an outer shaft is joined at one of its ends to an end of first inner adjacent shaft, and an opposite end of said first inner adjacent shaft is joined to an end of a second inner adjacent shaft, and so on, with said nested array having an inner shaft, with said outer shaft secured to a torque arm, with an end of said inner shaft coupled to said vessel, and with said nested array supported on said vessel for limited rotation about a common axis of said coaxial array.

8. The mooring system of claim 7, wherein said coaxial array is oriented vertically with respect to said vessel, and said coaxial array is supported between upper and lower support brackets, which are fixed to said vessel.

9. The mooring system of claim 1, wherein, said first and second yoke arms are rotatably coupled to said mooring body at a position above sea surface.

10. The mooring system of claim 1, wherein, said first and second yoke arms are rotatably coupled to said mooring body at a position below sea surface.

11. The mooring system of claim 10 further comprising;

a flow line frame mounted for three hundred sixty degree rotation with respect to said mooring body, and transfer crane means mounted on said vessel for providing access from said vessel to said flow line frame.

12. The mooring system of claim 1, wherein, each of said torsion spring devices comprises an elastomeric shear unit assembly, which includes circular rows of elastomeric shear blocks coupled to said vessel and to respective first and second torque shafts, which are connected to said first ends of said first and second torque arms.

13. The mooring system of claim 1, wherein, each of said torsion spring devices includes:

a stack of circular arrays of elastomeric shear units coupled together between a torque diaphragm ring and said vessel, with said torque diaphragm ring secured to a respective torque shaft; and with said torque shaft connected to said first end of a respective torque arm.

14. The mooring system of claim 13, wherein, each elastomeric shear unit array includes a plurality of elastomeric shear blocks arranged in a fill circular array.

15. The mooring system of claim 13, wherein, each elastomeric shear unit arrays includes a plurality of elastomeric shear blocks arranged in an open circular arch pattern.

16. The mooring system of claim 1, wherein each of said torsion spring devices comprises, a plurality of elastomeric shear unit arrays stacked on top of each other, each elastomeric shear unit array being fastened to shear plane stiffening a plurality of elastomeric shear units arranged in a circular row thereon, with a shear plane stiffening ring of a lower most elastomeric shear unit secured to said vessel, and a torque diaphragm ring secured to top surfaces of said elastomeric shear units of an upper most elastomeric shear unit array, with said torque diaphragm ring secured to a respective torque shaft, and with said torque shaft connected to said first end of a respective torque arm.

17. The mooring system of claim 16, wherein, said elastomeric shear unit arrays includes a plurality of shear fender units arranged in a circular row.

18. The mooring system of claim 16, wherein, said elastomeric shear unit arrays includes a plurality of shear fender units arranged in a partial circular row.

19. The mooring system of claim 16, wherein, said respective torque shaft includes an extension member which extends to an upper point above top surfaces of said uppermost elastomeric shear unit array.

20. The mooring system of claim 1, wherein, each of said spring devices includes:

a lower stack of elastomeric shear unit arrays positioned between a torque diaphragm ring and said vessel, an upper stack of elastomeric shear unit arrays positioned between a compression load distribution ring and said torque diaphragm, a frame coupled to said vessel and including an upper frame member, hydraulic rams positioned between said compression load distribution ring and said upper frame member, said hydraulic rams being designed and arranged when activated to place said upper and lower stacks of elastomeric shear units in compression, wherein, said torque diaphragm ring is secured to a respective torque shaft, and said torque shaft is connected to said first end of a respective torque arm.

21. The mooring system of claim 20, wherein, each elastomeric shear unit array includes a plurality of shear units arranged in a full circular array.

22. The mooring system of claim 20, wherein, each elastomeric shear unit array includes a plurality of shear units arranged in an open circular arch pattern and wherein said respective torque arms are connected to the torque diaphragm and the torque shaft in the open sector of the shear unit arch, where no shear units are located.

23. The mooring system of claim 1, wherein, each of said spring devices includes, a lower stack of elastomeric shear unit arrays positioned between a first torque diaphragm ring and said vessel, an upper stack of elastomeric shear rings positioned between a compression load distribution ring and a second torque diaphragm ring, said first and second torque diaphragm rings connected vertically by stiffeners to form a torque drum diaphragm, a frame coupled to said vessel and including an upper frame member, hydraulic rams positioned between said compression load distribution ring and said upper frame member, said hydraulic rams being designed and arranged when activated to place said upper and lower stacks of elastomeric shear units in compression, wherein, said torque drum diaphragm is secured to said first end of a respective torque arm.

24. The mooring system of claim 1, wherein, said first and second yoke arms and said first and second torque arms are positioned above sea surface between said mooring body and said torsion spring device.

25. The mooring system of claim 24, wherein, said torsion spring devices comprise a plurality of nested tubular shafts, which are coupled end to end to each other in a coaxial array.

26. The mooring system of claim 24, wherein, said torsion spring devices include an elastomeric shear unit assembly, which includes circular rows of elastomeric shear units coupled to said vessel and to respective first and second torque shafts, which are connected to said first ends of said first and second torque arms.

27. The mooring system of claim 1, wherein, each of said spring devices includes:

a lower stack of elastomeric shear unit arrays positioned between a torque diaphragm device and said vessel, an upper stack of elastomeric shear unit arrays positioned between a compression load distribution ring and said torque diaphragm device, a frame coupled to said vessel and including an upper frame member, hydraulic rams positioned between said compression load distribution ring and said upper frame member, said hydraulic rams being designed and arranged when activated to place said upper and lower stacks of elastomeric shear units in compression, wherein, said first end of a respective torque arm is directly connected to said torque diaphragm device, and is clamped between said upper stack and said lower stack of elastomeric shear unit arrays, whereby each of said respective torque arms is cantilevered from said upper stack and said lower stack of elastomeric shear unit arrays.

28. The mooring system of claim 27, wherein, said torque diaphragm device is a torque diaphragm drum positioned between said lower and upper stacks of elastomeric shear unit arrays.

29. The mooring system of claim 27, further including, a plurality of radial thrust brackets positioned laterally between said compression load distribution ring and said frame, whereby lateral loads transferred from said torque arm to said spring device are resisted by said radial thrust brackets.

30. The mooring system of claim 27, wherein, said shear units of said elastomeric shear unit arrays are shear fender units.

31. The mooring system of claim 30, wherein, said shear fender units are blocks of elastomeric material with steel plate laminations embedded therein.

32. The mooring system of claim 31, wherein, said shear fender units are designed and arranged with a number of steel plate laminations to provide adequate compression stiffness to support said cantilevered torque arms without excessive vertical deflection of said torque arms.

33. The mooring system of claim 27, wherein, at least one of said elastomeric shear unit arrays has elastomeric shear units arranged with uniform spacing from each other in a circular row.

34. The mooring system of 27, wherein, at least one of said elastomeric shear unit arrays has first elastomeric shear units non-uniformly arranged in a circular row and has second elastomeric shear units arranged in a circular arch which is concentric with said circular row, with said circular arch of said second elastomeric shear units positioned to face said first end of said respective torque arm where said torque arm is directly connected to said torque diaphragm device.

35. The mooring system of claim 34, wherein, said circular row of first elastomeric shear units has more elastomeric shear units placed in circular arches which face away and toward said torque arm than in circular arches which face perpendicularly from said torque arm.

36. The mooring system of claim 27, wherein, at least one of said elastomeric shear unit arrays has elastomeric shear units non-uniformly arranged with respect to each other in a circular row.

37. The mooring system of claim 36, wherein, said elastomeric shear units are arranged in first and second circular arches, with said first circular arch facing toward said torque arm and with said second circular arch facing away from said torque arm at its connection to said torque diaphragm device.

38. The mooring system of claim 37, wherein, said first circular arch has more elastomeric shear units therein than the number of elastomeric shear units in said second circular arch.

39. The mooring system of claim 1, wherein, said first and second yoke arms and said first and second torque arms are positioned below sea surface between said mooring body and said torsion spring device.

40. The mooring system of claim 39, wherein, said torsion spring devices comprise a plurality of nested tubular shafts, which are coupled end to end to each other in a coaxial array.

41. The mooring system of claim 39, wherein, said torsion spring devices include an elastomeric shear unit assembly, which includes circular arrays of elastomeric shear units coupled to said vessel and to respective first and second torque shafts, which are connected to said first ends of said first and second torque arm.

42. The mooring system of claim 4, wherein, said nested tubular shafts are oriented generally vertically with respect to said vessel, and said torque arms are coupled to and extend generally in a horizontal direction from said nested tubular shafts.

43. The mooring system of claim 4, wherein, said nested tubular shafts are oriented generally horizontally with respect to said vessel, and said torque arms are coupled to and extend generally in a vertical direction from said nested tubular shafts in a neutral no-load position.

44. The mooring system of claim 43, wherein, said nested tubular shafts extend from a support position at the center of said vessel bow to an outer support position.

45. The mooring system of claim 44, wherein, each of said nested tubular shafts extends across the bow of the vessel, between support positions on opposite sides of said vessel.

46. The mooring system of claim 45, wherein, said torque arms are of equal lengths, and said first and second yoke arms are of unequal lengths.

47. The mooring system of claim 45, wherein, said nested tubular shafts are oriented generally horizontally with respect to said vessel and said torque arms are oriented in opposite angular directions from a vertical position, and said first and second yoke arms are of substantially equal lengths.

48. The mooring system of claim 43, wherein, said nested tubular shafts are carried by a frame, which extends upwardly from a bow of said vessel, and said torque arms are designed and arranged in cooperation with a height of said frame so that under fully loaded conditions of said vessel, said torque arms and said yoke arms are above sea surface.

49. The mooring system of claim 43, wherein, said nested tubular shafts are carried by a frame, which is below a top surface of a bow of said vessel, and said torque arms are designed and arranged in cooperation with a height of said frame so that under fully loaded conditions of said vessel, said torque arms and said yoke arms are below a sea surface, but said frame is above said sea surface.

50. The mooring system of claim 49, wherein, a torque arm base is coupled diagonally between said torque arm and said nested tubular shafts.

51. The mooring system of claim 43, wherein, said nested tubular shafts are mounted within a support casing by a bracket arrangement inwardly of the bow hull structure.

52. The mooring system of claim 43, wherein, said nested tubular shafts are mounted at a position beneath sea surface, and said first ends of said torque arms respectively are coupled to said nested tubular shafts at a submerged position and extend generally vertically to a position above sea surface for connection respectively to said second ends of said yoke arms.

* * * * *

UNITED STATES PATENT AND TRADEMARK OFFICE

CERTIFICATE OF CORRECTION

PATENT NO. : 6,227,135 B1
DATED : May 8, 2001
INVENTOR(S) : Kristen I. Pedersen

It is certified that error appears in the above-identified patent and that said Letters Patent is hereby corrected as shown below:

Column 2,
Line 41, delete "anal", insert -- an alternative --.

Column 5,
Line 21, delete "5L", insert -- 5I --

Column 7,
Line 56, delete "411", insert -- 41I --
Line 66, delete "5B", insert -- 5H --

Column 8,
Line 49, delete "5O", insert -- 5Q --

Signed and Sealed this

Eighteenth Day of December, 2001

*Attest:*

*Attesting Officer*

JAMES E. ROGAN
*Director of the United States Patent and Trademark Office*